US010055940B2

(12) United States Patent
Arnone et al.

(10) Patent No.: US 10,055,940 B2
(45) Date of Patent: Aug. 21, 2018

(54) HEAD-TO-HEAD AND TOURNAMENT PLAY FOR ENRICHED GAME PLAY ENVIRONMENT

(71) Applicant: Gamblit Gaming, LLC, Glendale, CA (US)

(72) Inventors: Miles Arnone, Sherborn, MA (US); Frank Cire, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 15/489,343

(22) Filed: Apr. 17, 2017

(65) Prior Publication Data

US 2017/0228986 A1 Aug. 10, 2017

Related U.S. Application Data

(63) Continuation of application No. 15/190,745, filed on Jun. 23, 2016, now Pat. No. 9,626,836, which is a continuation of application No. 14/271,360, filed on May 6, 2014, now Pat. No. 9,384,631, which is a continuation of application No. 13/920,031, filed on Jun. 17, 2013, now Pat. No. 8,715,069, which is a continuation of application No. PCT/US2012/060683, filed on Oct. 17, 2012.

(Continued)

(51) Int. Cl.
*G07F 17/32* (2006.01)

(52) U.S. Cl.
CPC ..... *G07F 17/3279* (2013.01); *G07F 17/3211* (2013.01); *G07F 17/3227* (2013.01); *G07F 17/3244* (2013.01)

(58) Field of Classification Search
None
See application file for complete search history.

(56) References Cited

U.S. PATENT DOCUMENTS 5,413,357 A 5/1995 Schulze et al.
5,718,429 A 2/1998 Keller
(Continued)

FOREIGN PATENT DOCUMENTS

JP 06277360 A 10/1994
JP 2001300098 A 10/2001
(Continued)

OTHER PUBLICATIONS

U.S. Appl. No. 15/063,365 Arnone, et al. filed Mar. 7, 2016.
(Continued)

*Primary Examiner* — Jason Skaarup
(74) *Attorney, Agent, or Firm* — Caitlyn Ross

(57) ABSTRACT

A network distributed hybrid game system has a real world server, a game world server, a controller and a global betting manager; the real world server provides a real world credit meter and wagering results, the controller provides an entertainment game, the game world server distributes wager triggers from the controller to the real world server, and interfaces with the global betting manager to provide side bets based on game data from the controller and distributes results of side bets to the real world server that adjusts the real world credit meter.

12 Claims, 14 Drawing Sheets

Related U.S. Application Data

(60) Provisional application No. 61/627,749, filed on Oct. 17, 2011, provisional application No. 61/630,194, filed on Dec. 6, 2011.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,308,556 B2 11/2012 Thomas
8,317,598 B2 11/2012 McNally
8,430,735 B2 4/2013 Oberberger
8,475,266 B2 7/2013 Amone
8,480,470 B2 7/2013 Napolitano et al.
8,622,809 B1 1/2014 Arora et al.
8,684,829 B2 * 4/2014 Arnone ..... G07F 17/3288 463/16
8,864,564 B2 10/2014 Oberberger
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0073882 A1 * 4/2006 Rozkin ..... G07F 17/32 463/25
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0146344 A1 * 6/2008 Rowe ..... G07F 17/3288 463/42
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar

(56) References Cited

U.S. PATENT DOCUMENTS

2008/0254854 A1* 10/2008 Slomiany ..... G07F 17/32 463/19
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0104965 A1* 4/2009 House ..... G06Q 20/3674 463/20
2009/0111573 A1* 4/2009 Iddings ..... G07F 17/3244 463/25
2009/0118006 A1 5/2009 Kelly et al.
2009/0124344 A1 5/2009 Mitchell et al.
2009/0131158 A1 5/2009 Brunet De Courssou et al.
2009/0131175 A1* 5/2009 Kelly ..... G07F 17/3267 463/42
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Amone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt et al.
2017/0076553 A1* 3/2017 Washington ..... G07F 17/3288

FOREIGN PATENT DOCUMENTS

JP 2003111980 A 4/2003
JP 2004097610 A 4/2004
JP 2004166746 A 6/2004
JP 2005-27950 A 2/2005
WO 9851384 A1 11/1998
WO 2010087090 A1 8/2010
WO 2011109454 A1 9/2011
WO 2012139083 A1 10/2012
WO 2013059308 A1 4/2013

OTHER PUBLICATIONS

U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed Jun. 8, 2016.
U.S. Appl. No. 15/170,773 Arnone, et al. filed Jun. 1, 2016.
U.S. Appl. No. 15/179,940 Arnone, et al. filed Jun. 10, 2016.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.

(56) References Cited

OTHER PUBLICATIONS

U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
Japan Patent Office, Office Action, Japan Patent Application No. 2014-535999, dated Jul. 29, 2015, Japan.
IP Australia, Patent Examination Report No. 1, Australia Patent Application No. 2012326136, dated May 17, 2014.
IP Office of the Philippines, Substantive Examination Report, Philippine Patent Application No. 1/2014/500861, dated Jan. 19, 2016.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.

(56) References Cited

OTHER PUBLICATIONS

U.S. Appl. No. 14/586,626 Arnone, et al. filed Dec. 30, 2014.
U.S. Appl. No. 14/586,639 Arnone, et al. filed Dec. 30, 2014.
WIPO/ISA International Search Report and Written Opinion, PCT/US12/60683, dated Apr. 15, 2013.
WIPO/IPEA, International Preliminary Report on Patentability, PCT/US12/60683, dated May 1, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
Canadian Patent Office, Further Office Action, Patent Application No. 2,852,464, dated Apr. 5, 2017.
International Search Report and Written Opinion, PCT/US2012/060683, dated Apr. 15, 2013.

* cited by examiner

450

| N | 10% | 7.5% | 5% | 2.5% | 1% | | N | 10% | 7.5% | 5% | 2.5% | 1% |
|---|---|---|---|---|---|---|---|---|---|---|---|---|
| 3 | 1.15 | 1.15 | 1.15 | 1.15 | 1.15 | | 53 | | | 2.981 | 3.151 | |
| 4 | 1.42 | 1.44 | 1.46 | 1.48 | 1.49 | | 54 | | | 2.986 | 3.158 | |
| 5 | 1.60 | 1.64 | 1.67 | 1.71 | 1.75 | | 55 | | | 2.995 | 3.165 | |
| 6 | 1.73 | 1.77 | 1.82 | 1.89 | 1.94 | | 56 | | | 3.002 | 3.172 | |
| 7 | 1.83 | 1.88 | 1.94 | 2.02 | 2.10 | | 57 | | | 3.009 | 3.179 | |
| 8 | 1.91 | 1.96 | 2.03 | 2.13 | 2.22 | | 58 | | | 3.016 | 3.186 | |
| 9 | 1.98 | 2.04 | 2.11 | 2.21 | 2.32 | | 59 | | | 3.023 | 3.193 | |
| 10 | 2.03 | 2.10 | 2.18 | 2.29 | 2.41 | | 60 | | | 3.030 | 3.200 | |
| 11 | 2.09 | 2.14 | 2.23 | 2.36 | 2.48 | | 61 | | | 3.036 | 3.206 | |
| 12 | 2.13 | 2.20 | 2.29 | 2.41 | 2.55 | | 62 | | | 3.042 | 3.212 | |
| 13 | 2.17 | 2.24 | 2.33 | 2.46 | 2.61 | | 63 | | | 3.048 | 3.218 | |
| 14 | 2.21 | 2.28 | 2.37 | 2.51 | 2.66 | | 64 | | | 3.054 | 3.224 | |
| 15 | 2.25 | 2.32 | 2.41 | 2.55 | 2.71 | | 65 | | | 3.060 | 3.230 | |
| 16 | 2.28 | 2.35 | 2.44 | 2.59 | 2.75 | | 66 | | | 3.066 | 3.236 | |
| 17 | 2.31 | 2.38 | 2.47 | 2.62 | 2.79 | | 67 | | | 3.072 | 3.242 | |
| 18 | 2.34 | 2.41 | 2.50 | 2.65 | 2.82 | | 68 | | | 3.078 | 3.248 | |
| 19 | 2.36 | 2.44 | 2.53 | 2.68 | 2.85 | | 69 | | | 3.084 | 3.254 | |
| 20 | 2.38 | 2.46 | 2.56 | 2.71 | 2.88 | | 70 | | | 3.090 | 3.260 | |
| 21 | | | 2.58 | 2.73 | 2.91 | | 71 | | | 3.095 | 3.265 | |
| 22 | | | 2.60 | 2.76 | 2.94 | | 72 | | | 3.100 | 3.270 | |
| 23 | | | 2.62 | 2.78 | 2.96 | | 73 | | | 3.105 | 3.275 | |
| 24 | | | 2.64 | 2.80 | 2.99 | | 74 | | | 3.110 | 3.280 | |
| 25 | | | 2.66 | 2.82 | 3.01 | | 75 | | | 3.115 | 3.285 | |
| 26 | | | 2.680 | 2.840 | | | 76 | | | 3.120 | 3.290 | |
| 27 | | | 2.700 | 2.860 | | | 77 | | | 3.125 | 3.295 | |
| 28 | | | 2.720 | 2.880 | | | 78 | | | 3.130 | 3.300 | |
| 29 | | | 2.730 | 2.900 | | | 79 | | | 3.135 | 3.305 | |
| 30 | | | 2.750 | 2.910 | | | 80 | | | 3.140 | 3.310 | |
| 31 | | | 2.760 | 2.930 | | | 81 | | | 3.144 | 3.314 | |
| 32 | | | 2.780 | 2.950 | | | 82 | | | 3.148 | 3.318 | |
| 33 | | | 2.790 | 2.960 | | | 83 | | | 3.152 | 3.322 | |
| 34 | | | 2.810 | 2.970 | | | 84 | | | 3.156 | 3.326 | |
| 35 | | | 2.820 | 2.980 | | | 85 | | | 3.160 | 3.330 | |
| 36 | | | 2.830 | 2.992 | | | 86 | | | 3.164 | 3.334 | |
| 37 | | | 2.840 | 3.004 | | | 87 | | | 3.168 | 3.338 | |
| 38 | | | 2.850 | 3.016 | | | 88 | | | 3.172 | 3.342 | |
| 39 | | | 2.860 | 3.028 | | | 89 | | | 3.176 | 3.346 | |
| 40 | | | 2.870 | 3.040 | | | 90 | | | 3.180 | 3.350 | |
| 41 | | | 2.880 | 3.050 | | | 91 | | | 3.183 | 3.353 | |
| 42 | | | 2.890 | 3.060 | | | 92 | | | 3.186 | 3.356 | |
| 43 | | | 2.900 | 3.070 | | | 93 | | | 3.189 | 3.359 | |
| 44 | | | 2.910 | 3.080 | | | 94 | | | 3.192 | 3.362 | |
| 45 | | | 2.920 | 3.090 | | | 95 | | | 3.195 | 3.365 | |
| 46 | | | 2.928 | 3.098 | | | 96 | | | 3.198 | 3.368 | |
| 47 | | | 2.936 | 3.106 | | | 97 | | | 3.201 | 3.371 | |
| 48 | | | 2.944 | 3.114 | | | 98 | | | 3.204 | 3.374 | |
| 49 | | | 2.952 | 3.122 | | | 99 | | | 3.207 | 3.377 | |
| 51 | | | 2.967 | 3.137 | | | 100 | | | 3.210 | 3.380 | |
| 52 | | | 2.974 | 3.144 | | | | | | | | |

FIG. 5B

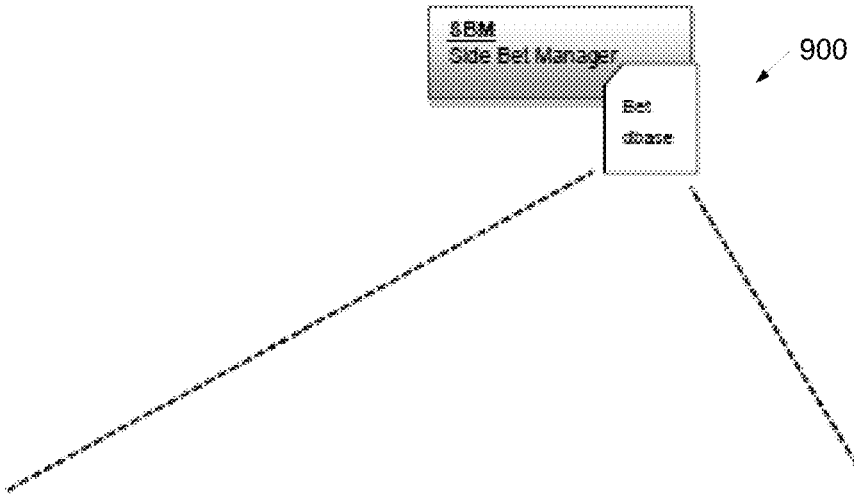

| Player 1 Chess Piece | Assigned Value | Piece Captured by Player 2 (Y/N) | Result of Play |
|---|---|---|---|
| | | | |
| Pawn 1 | 15 credits | N | 0 credits awarded to Player 2 |
| Pawn 2 | 10 credits | Y | 10 credits awarded to Player 2 |
| Pawn 3 | 20 credits | Y | 20 credits awarded to Player 2 |
| Pawn 4 | 15 credits | Y | 15 credits awarded to Player 2 |
| Pawn 5 | 5 credits | N | 0 credits awarded to Player 2 |
| Pawn 6 | 15 credits | Y | 15 credits awarded to Player 2 |
| Pawn 7 | 0 credits | Y | 0 credits awarded to Player 2 |
| Pawn 8 | 10 credits | N | 0 credits awarded to Player 2 |
| Queen's Rook | 25 credits | N | 0 credits awarded to Player 2 |
| King's Rook | 35 credits | N | 0 credits awarded to Player 2 |
| Queen's Knight | 5 credits | Y | 5 credits awarded to Player 2 |
| King's Knight | 10 credits | Y | 10 credits awarded to Player 2 |
| Queen's Bishop | 20 credits | Y | 20 credits awarded to Player 2 |
| King's Bishop | 5 credits | Y | 5 credits awarded to Player 2 |
| Queen | 30 credits | Y | 30 credits awarded to Player 2 |
| King | | N/A | |
| Total | 200 credits | | 130 credits awarded to Player 2 |

FIG. 8

HEAD-TO-HEAD AND TOURNAMENT PLAY FOR ENRICHED GAME PLAY ENVIRONMENT

CROSS REFERENCE TO RELATED APPLICATIONS

This application is a continuation of U.S. patent application Ser. No. 15/190,745 filed on Jun. 23, 2016, which is a continuation of U.S. patent application Ser. No. 14/271,360, filed on May 6, 2014 and issued as U.S. Pat. No. 9,384,631 on Jul. 5, 2016, which is a continuation of U.S. patent application Ser. No. 13/920,031, filed on Jun. 17, 2013 and issued as U.S. Pat. No. 8,715,069 on May 6, 2014, which is a continuation of Patent Cooperation Treaty Application No. PCT/US12/60683, filed Oct. 17, 2012, which claims the benefit of U.S. Provisional Application Nos. 61/627,749, filed Oct. 17, 2011, and 61/630,194, filed Dec. 6, 2011, the contents of each of which are hereby incorporated by reference in their entirety as if stated in full herein. This application references Patent Cooperation Treaty patent application Nos. PCT/US11/26768, filed Mar. 1, 2011, PCT/US11/63587, filed Dec. 6, 2011, and PCT/US12/58156, filed Sep. 29, 2012, the contents of each of which are hereby incorporated by reference in their entirety as if stated in full herein.

FIELD OF THE INVENTION

Embodiments of the present invention are generally related to gaming and more specifically to a head-to-head entertainment game played among players with various skill levels in a hybrid game that includes both a gambling game and an entertainment game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems for an enhanced head-to-head hybrid game are provided. Many embodiments include a real world server connected to a game world engine by a network, wherein the real world server is constructed to: receive from the game world server via the network, a trigger of a wager of an amount of real world credits; and provide a randomly generated payout of real world credits for the wager of the amount of real world credits wherein the result is determined using a random number generator; a controller connected to the game world server by the network, wherein the controller is constructed to: provide an entertainment game providing outcomes based upon a player's skillful execution of the entertainment game while utilizing a resource of the entertainment game; generate a perceivable display of the entertainment game; and convey to the game world server via the network, actions taken by the player during the player's skillful execution of the entertainment game while utilizing the resource of the entertainment game; and the game world server connected by the network to the real world server and connected to the controller, wherein the game world server is constructed to: receive from the controller via the network, the actions taken by the player; determine player performance measurements for the player based on the actions taken by the player; convey to the real world server via the network, the trigger of the wager of the amount of real world credit based on the actions taken by the player; determine eligibility of the player for head-to-head of the entertainment game of the controller; assign a handicap for the head-to-head play to the player based upon the player performance measurements for the player, wherein the handicap is a random element introduced into a game world of the player during the head-to-head play, and wherein the handicap is based upon a ratio of game world credit earned as an outcome of the player's skillful execution of the entertainment game and the amount of real world credits utilized by the player in the wager as triggered by the real world server upon the player's utilization of the resource during the player's skillful execution of the entertainment game while earning the game world credit; and introduce the random element of the handicap into the game world of the player during the head-to-head play.

In many embodiments, the player performance measurements include the outcome of game world credit earned upon the player's skillful execution of the entertainment game while utilizing the resource of the entertainment game and the amount of real world credits utilized by the player in the wager of the amount of real world credits as triggered in the gambling game by the utilization of the resource of the entertainment game.

In additional embodiments, determining eligibility of the player for play in the tournament and assigning the handicap for the tournament to the player is based upon a ratio of the game world credit earned as the outcome of the player's skillful execution of the entertainment game and the amount of real world credits utilized by the player in the wager as triggered in the gambling game upon the player's utilization of the resource during the player's skillful execution of the entertainment game while earning the game world credit.

In some embodiments, of the enhanced head-to-head hybrid game system, the random element causes a game piece not to respond to a command.

In other embodiments of an enhanced head-to-head hybrid game system the random element causes an accuracy with which shots can be aimed at targets to be a function of the aim of the player plus a random component that impacts the trajectory of the player's shot.

In some embodiments, the random element causes cars available to more skilled players in a racing game to break down more readily.

In various embodiments, the random element causes a more skilled player in the shooting game not be able to use certain guns or other weaponry.

In numerous embodiments, the random element causes a more skilled player in a shooting game to not be able to use certain guns or other weaponry.

In various embodiments, the random element causes the player's baskets to be worth less than another player's.

In various embodiments, the game world server and the controller are constructed using a same processing apparatus.

In some embodiments, the game world server and the controller are constructed using different processing apparatuses, and wherein the game world server and the controller are connected by respective communication interfaces of the processing apparatuses over a network.

In other embodiments, the real world credit is a currency fungible instrument.

In various embodiments, the game world credit is a currency fungible instrument.

In some embodiments, a computer-implemented method of operating an enhanced head-to-head hybrid game system is provided. The method includes configuring at least one processor as a real world engine constructed to provide a randomly generated payout of real world credits for a wager of an amount of real world credits; configuring at least one processor as an entertainment software engine constructed to provide an entertainment game providing an outcome of game world credit earned upon a player's skillful execution of the entertainment game while utilizing a resource of the entertainment game; configuring at least one processor as a game world engine constructed to manage the entertainment software engine and communicate gameplay gambling event occurrences based upon the player's utilization of the resource during the player's skillful execution of the entertainment game that trigger the wager of the amount of real world credits and generation of the randomly generated payout of real world credits by the real world engine; and configuring at least one processor as a global betting manager constructed to: receive player performance measurements for the player from the game world engine; determine eligibility of the player for play in a tournament and assign by the global betting manager a handicap for the tournament to the player based upon the player performance measurements for the player, wherein the handicap for the tournament is a random element introduced into the game world of the player during tournament play; and send information concerning tournament eligibility and the assigned handicap to the game world engine that configures the game world engine to implement the assigned handicap and tournament eligibility within the enhanced head-to-head hybrid game.

In various embodiments, a non-transitory machine-readable medium is provided. The machine-readable medium stores processor instructions, where execution of the instructions by one or more processors cause the one or more processors to perform a process for a head-to-head hybrid game, the process including: configuring at least one processor as a real world engine constructed to provide a randomly generated payout of real world credits for a wager of an amount of real world credits; configuring at least one processor as an entertainment software engine constructed to provide an entertainment game providing an outcome of game world credit earned upon a player's skillful execution of the entertainment game while utilizing a resource of the entertainment game; configuring at least one processor as a game world engine constructed to manage the entertainment software engine and communicate gameplay gambling event occurrences based upon the player's utilization of the resource during the player's skillful execution of the entertainment game that trigger the wager of the amount of real world credits and generation of the randomly generated payout of real world credits by the real world engine; and configuring at least one processor as a global betting manager constructed to: receive player performance measurements for the player from the game world engine; determine eligibility of the player for play in a tournament and assign by the global betting manager a handicap for the tournament to the player based upon the player performance measurements for the player, wherein the handicap for the tournament is a random element introduced into the game world of the player during tournament play; and send information concerning tournament eligibility and the assigned handicap to the game world engine that configures the game world engine to implement the assigned handicap and tournament eligibility within the enhanced head-to-head hybrid game.

BRIEF DESCRIPTION OF THE DRAWINGS

FIG. 5B is a lookup table for a process for determining if a player's current performance at an enhanced head-to-head hybrid game exceeds historical performance in accordance with an embodiment of the invention.

FIG. 8 is a diagram of a side bet manager database in accordance with an embodiment of the invention.

DETAILED DESCRIPTION

Figure 1A:
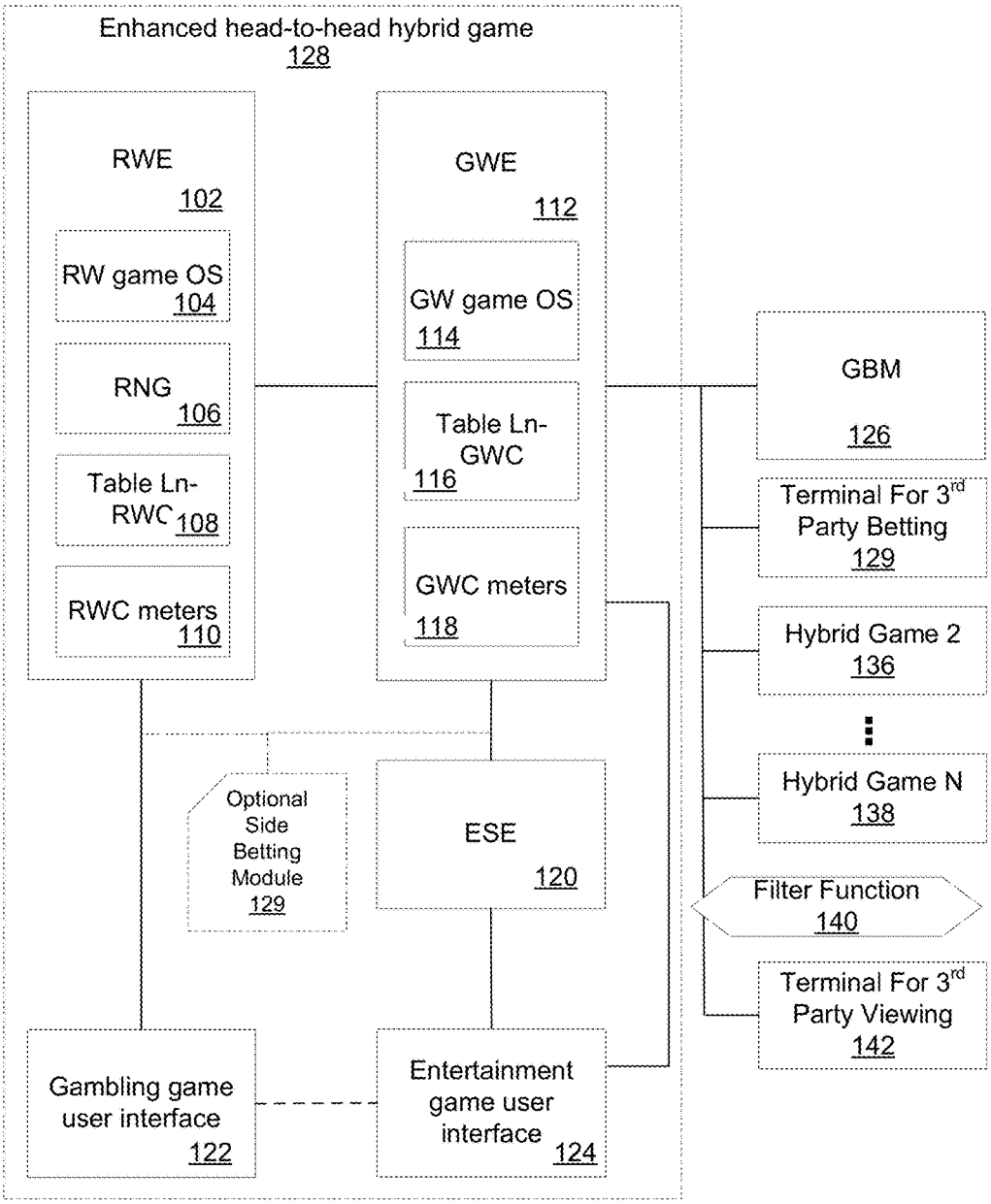
FIG. 1A illustrates an enhanced head-to-head hybrid game in accordance with an embodiment of the invention.

Turning now to the drawings, systems and methods for operation of an enhanced head-to-head hybrid game are illustrated. In several embodiments, an enhanced head-to-head hybrid game is a form of a hybrid game that integrates both a gambling game that includes a real world engine (RWE) which manages the gambling game, as well as an entertainment game that includes a game world engine (GWE) which manages the entertainment portion of a game, and an entertainment software engine (ESE) which executes the game for user entertainment. In certain embodiments, the enhanced head-to-head hybrid game also includes a user interface associated with either or both the gambling game and the entertainment game.

In operation of an enhanced head-to-head hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of game world objects, experience points, points, etc. Wagers are made in the gambling game using real world credits (RC or RWC). The real world credits can be credits in an actual currency, or may be credits in a virtual currency. Gambling outcomes from the gambling game may cause consumption, loss or accrual of real or virtual credits. In addition, gambling outcomes in the gambling game may influence elements in the entertainment game such as by restoring a consumed element, causing the loss of an element, restoration or placement of a fixed element, etc. Example elements include enabling elements (EE) which are elements that enable a player's play of the entertainment game and may be consumed during play and may also be replenished during play within the entertainment game. Other types of elements include actionable elements (AE) which are elements that are acted upon and may not be restorable during normal play of the entertainment game.

Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

Given the attraction of popular and familiar entertainment titles, players may want to engage in skill-based play and wins. To satisfy these requirements, in some embodiments of an enhanced head-to-head hybrid game, the enhanced head-to-head hybrid game system allows for play against the machine, head-to-head and tournament play organized by players or operators, where the outcomes of which are dependent in whole or in part on skill. The operation of gambling games, triggered by occurrences within the entertainment game (e.g. consumption of an enabling element, occurrence of an action element, etc.) may also take place, but is not required, i.e. the enhanced head-to-head hybrid game may be configured such that the gambling game including a real world engine system is entirely dormant, such that the only randomness is supplied by an entertainment software engine (ESE) entertainment game, and ranges in between (meaning, no real world wagering results impact to partial real world wagering results influence on the ESE game, to heavy influence). In such play, the enhanced head-to-head hybrid game operates much like a conventional video arcade game. This construct allows familiar game play and a degree of control that appeals to younger generations.

In some embodiments, measures to allow and/or fund head-to-head and tournament play organized by operators or players in which a random number generator (RNG) may not be a factor and where betting as a function of skill-related performance and/or outcomes is permitted. The system allows head-to-head and/or tournament play between a single player and the computer, between two or more players against one another, or multiple players playing against the computer and/or each other, and specifically, concerns the process by which players bet on the outcome of the skill game. For example, if the skill game is a version of Madden Football™ a player can bet on whether or not he is going to beat the computer, or if he is playing against another player, that player. These bets can be made, for instance, on the final outcome of the game, and/or the state of the game along various intermediary points (e.g. the score at the end of the 1st quarter), assigned values to specific pieces, and/or on various measures associated with the game (e.g. total offensive yards, number of turnovers, number of sacks, etc.). Players will bet against one another, or engage the computer in a head-to-head competition in the context of their skill level in the game in question. Each of these aspects can be used singularly or in conjunction with one or more of the other aspects.

Enhanced Head-To-Head Hybrid Games

In many embodiments, an enhanced head-to-head hybrid game integrates high levels of entertainment content with a game of skill (entertainment game), a gambling experience with a game of chance (gambling game), and a fair game play experience irrespective of player skill level with a global betting manager. An enhanced head-to-head hybrid game provides for a random outcome independent of player skill while providing that the user's gaming experience (as measured by obstacles/challenges encountered, time of play and other factors) is shaped by the player's skill. An enhanced head-to-head hybrid game in accordance with an embodiment of the invention is illustrated in FIG. 1A. The enhanced head-to-head hybrid game 128 includes a RWE 102, GWE 112, ESE 120, gambling game user interface 122, entertainment game user interface 124 and a global betting manager 126. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124. The global betting manager 126 is connected with the GWE 112.

In several embodiments, the RWE 102 is the fundamental operating system for the gambling game of the enhanced head-to-head hybrid game 128 and controls and operates the gambling game. The operation of a gambling game is enabled by money, such as real funds, accretes and declinates real gambling credits based on random gambling outcome, and whose gambling proposition is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithm and/or processes, which are used to generate random outcomes. A level "n" real-world credit pay table (Table Ln-RWC) 108 is a table that can be used in conjunction with a random number generator (RNG) 106 to dictate the real world credits (RWC) earned as a function of game play and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game "level n" need not be the same for each level.

In many embodiments, the GWE 112 manages the overall enhanced head-to-head hybrid game operation, with the RWE 102 and the ESE 120 effectively being support units to the GWE 112. In several embodiments, the GWE 112 includes mechanical, electronic and software system for an entertainment game. The GWE 112 includes a GW game operating system (OS) 114 that provides control of the entertainment game. The GWE additionally includes a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally includes various audit logs and activity meters (such as the game world credit (GWC) meter) 118. The GWE 112 can also couple to a centralized server for exchanging various data related to the player and their activities on the game. The GWE 112 furthermore couples to the ESE 120.

In many embodiments, a level "n" game world credit pay table (Table Ln-GWC) 116 dictates the GWC earned as a function of player skill in the nth level of the game. The payouts governed by this table are dependent upon player skill and game play at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of game play to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1A, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implement using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of an enhanced head-to-head hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independent from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's algorithm may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (i.e. power of the character, gun selection, car choice, etc.). In this manner, the player is always in control of the per game wager amount, with the choice mapping to some parameter or component that is applicable to the entertainment game experience of the hybrid game. In a particular embodiment, the RWE 102 operation can be a game of chance running every 10 seconds where the amount wagered is communicated from the GWE 112 as a function of choices the player makes in the operation profile in the entertainment game such as those cited above.

In many embodiments, an enhanced head-to-head hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance, such as a slot machine, is preserved. At the same time a rich environment of rewards to stimulate "gamers" can be established with the entertainment game. In several embodiments, the enhanced head-to-head hybrid game can leverage very popular titles with "gamers" and provides a sea change environment for casinos to attract players with games that are more akin to the type of entertainment which a younger generation desires. In various embodiments, players can use their skill towards building and banking game world credit (GWC) which in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, enhanced head-to-head hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The enhanced head-to-head hybrid game can include an entertainment game that includes head-to-head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to solitaire and babette).

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head to head competition in the context of their skill level in the entertainment game in question. As such, players can have a handicap associated with their player profile that describes their skill (which can be their "professed skill" in certain embodiments), and which is used by a GWE (such as a local GWE or a GWE that receives services from remote servers) to offer appropriate bets around the final and/or intermediate outcomes of the entertainment game, and/or to condition game play as a function of player skill, and/or to select players across one or more enhanced head-to-head hybrid games to participate in head to head games and/or tournaments.

Many embodiments enable the maximization of the number of players able to compete competitively by utilizing a skill normalization through the use of X factors or random elements introduced into the game world of specified players. Handicapping using X factors enables players of varying performance potential to compete competitively regardless of absolute skill level, such as but not limited to where a player whose skill level identifies the player as a beginner can compete in head to head or tournament play against a highly skilled player with meaningful results.

In several embodiments, wagers can be made among numerous enhanced head-to-head hybrid games with a global betting manager (GBM). The GBM is a system that coordinates wagers that are made across multiple enhanced head-to-head hybrid games by multiple players. In some implementations it can also support wagers by third parties relative to the in game performance of other players. The GBM can stand alone, or is capable of being embedded in one of a number of systems, including a local ESE or any remote server capable of providing services to an enhanced head-to-head hybrid game, or can operate independently on one or a number of servers on-site at a casino, as part of a larger network and/or the internet or "cloud" in general. The GBM also supports the management of lottery tickets issued as a function of game play.

In numerous embodiments, the enhanced head-to-head hybrid game provides measures to provide handicapping in the context of entertainment games where the outcome of the entertainment game is in part or in whole determined by player skill and where wagers as a function of skill related performance and/or outcomes is permitted.

Although various components of enhanced head-to-head hybrid games are discussed above, enhanced head-to-head hybrid games can be configured with any component appropriate to the requirements of a specific application in accordance with embodiments of the invention. Network connected enhanced head-to-head hybrid games are discussed further below.

Network Connected Enhanced Head-To-Head Hybrid Games

Enhanced head-to-head hybrid games in accordance with many embodiments of the invention can operate locally while being network connected to draw services from remote locations or to communicate with other enhanced head-to-head hybrid games. In numerous embodiments, a global betting manager receives player performance measurements from one or more enhanced head-to-head hybrid games and determines an appropriate skill level or ranking for the player based on those player performance metrics. Performance measurement data may include, but is not limited to, an outcome of the player playing the entertainment game, such as an expenditure, gain, loss or accumulation of GWC, player's experience points or the like (either as a rate or a total accumulation), a player's use of entertainment game resources such as EEs or AEs (either as a rate or an absolute amount) during one or more playing sessions, or a player's use, loss or accumulation of wagered credit resources, either real or virtual, (either as a rate or an absolute amount), etc. In addition, various other metrics may be derived from the performance measurement data, such as by determining a relationship, such as a ratio, between an outcome of the player's play of the entertainment game and a resource utilized by a player when playing the entertainment game. For example, determining the relationship of a rate of accumulation of GWC or other types of experience points by a rate of use of EE, credit, AE, etc. Other derivations may be determining a relationship between an accumulation of a GWC or other measure of experience by a total amount of a resource used, such as EEs, AEs, credits, etc. In a case where two or more players wish to compete against each other in a head to head enhanced head-to-head hybrid game, the global betting manager determines an appropriate X factor or random element for each player based on a comparison of the player's rankings.

Figure 1B:
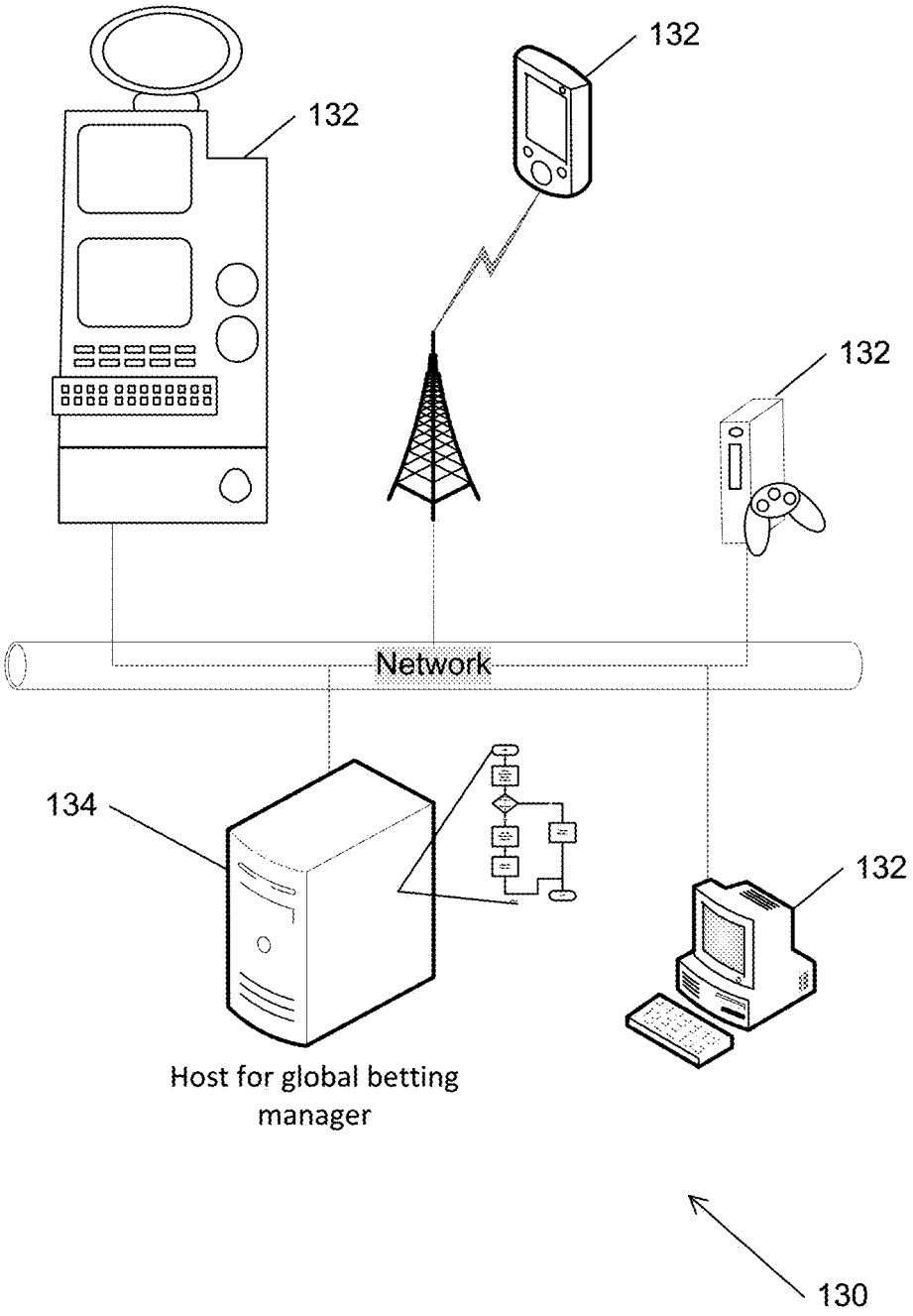
FIG. 1B is a deployment diagram illustrating an enhanced head-to-head hybrid game in accordance with an embodiment of the invention.

A deployment diagram of an enhanced head-to-head hybrid game in accordance with an embodiment of the invention is illustrated in FIG. 1B. In the diagram, an enhanced head-to-head hybrid game 130 may be hosted by any computing device 132 capable of presenting interactive entertainment and gambling games to a player, such as (but not limited to) a land based or casino gaming machine, a personal computer, a gaming console, a wireless device such as a personal digital assistant, notepad computer, or smart phone. The enhanced head-to-head hybrid games 130 may include a server 134 hosting a global betting manager connected with the various computing devices via a computer network, such as a local area network or a wide area network.

In many embodiments, operations associated with an enhanced head-to-head hybrid game such as (but not limited to) processes for calculating score or RWC and GWC tracking can be performed across multiple devices. These multiple devices can be implemented using or in connection with a single server or a plurality of servers such that an enhanced head-to-head hybrid game is executed as a system in a virtualized space, such as (but not limited to) where the RWE and GWE are large scale centralized servers "in the cloud" coupled to a plurality of widely distributed ESE controllers or clients via the Internet.

In many embodiments, an RWE server can perform certain functionalities of a RWE of an enhanced head-to-head hybrid game. In certain embodiments, a RWE server includes a centralized odds engine which can generate random outcomes (such as but not limited to win/loss outcomes) for a gambling game, thereby eliminating the need to have that functionality of the RWE performed locally within the enhanced head-to-head hybrid game. The RWE server can perform a number of simultaneous or pseudo-simultaneous runs in order to generate random outcomes for a variety of odds percentages that one or more networked enhanced head-to-head hybrid games may require. In certain embodiments, an RWE of an enhanced head-to-head hybrid game can send information to a RWE server including (but not limited to) Table Ln-RWC tables, maximum speed of play for a gambling game, gambling game monetary denominations or any promotional RWC provided by the operator of the enhanced head-to-head hybrid game. In particular embodiments, a RWE server can send information to a RWE of an enhanced head-to-head hybrid game including (but not limited to) RWC used in the gambling game, player account information or play activity and a profile associated with a player.

In several embodiments, a GWE server can perform the functionality of the GWE across various enhanced head-to-head hybrid games. These functionalities can include (but are not limited to) providing a method for monitoring high scores on select groups of games, linking groups of games in order to join them in head to head tournaments, and acting as a tournament manager.

In a variety of embodiments, management of player account information can be performed by a GWE patron management server separate from a GWE server. A GWE patron management server can manage player account information, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of an enhanced head-to-head hybrid game can send information to a GW patron management server including (but not limited to) GWC and RWC used in a game, player account information, play activity and profile information for players and synchronization information between a gambling game and an entertainment game or other aspects of an enhanced head-to-head hybrid game. In particular embodiments, a GW patron management server can send information to a GWE of an enhanced head-to-head hybrid game including (but not limited to) entertainment game title and type, tournament information, Table Ln-GWC tables, special offers, character or profile setup and synchronization information between a gambling game and an entertainment game or other aspects of an enhanced head-to-head hybrid game.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

Servers connected via a network to implement enhanced head-to-head hybrid games in accordance with many embodiments of the invention can communicate with each other to provide services utilized within an enhanced head-to-head hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the enhanced head-to-head hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of an enhanced head-to-head hybrid game tournament. Typically a GWE (such as a GWE that runs within an enhanced head-to-head hybrid game or on a GWE server) is not aware of the relationship of itself to the rest of a tournament since in a typical configuration the actual tournament play is managed by the ESE server. Therefore, management of an enhanced head-to-head hybrid game tournament can include (but is not limited to) tasks such as: conducting tournaments according to system programming that can be coordinated by an operator of the enhanced head-to-head hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of an enhanced head-to-head hybrid game, exchange of data necessary to link a player's profile to their ability to participate in various forms of game play (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular enhanced head-to-head hybrid game, as recorded in their player account, determining a player's play and gambling performance for the purposes of marketing intelligence, and logging secondary drawing awards, tournament prizes, RWC and GWC into the player's account.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with an enhanced head-to-head hybrid game locally. In certain embodiments, a server is a server system including a plurality of servers, where software may be run on one or more physical devices. Similarly, in particular embodiments, multiple servers may be combined on a single physical device.

Figure 1C:
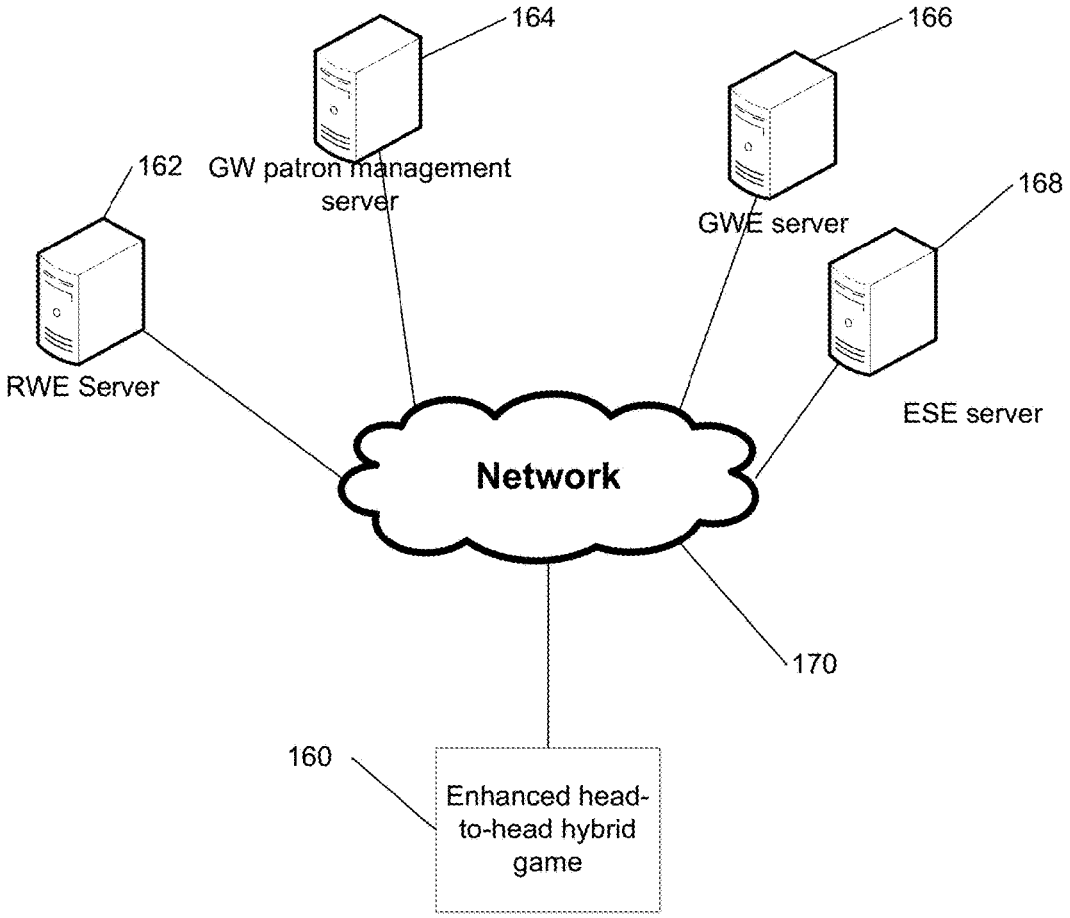
FIG. 1C is a system diagram that illustrates a network distributed enhanced head-to-head hybrid game in accordance with an embodiment of the invention.

Enhanced head-to-head hybrid games in accordance with many embodiments of the invention can be networked with remote servers in various configurations. A networked enhanced head-to-head hybrid game in accordance with an embodiment of the invention is illustrated in FIG. 1C. The networked enhanced head-to-head hybrid game 160 is connected with a RWE server 162, GW patron management server 164, GWE server 166 and ESE server 168 over a network 170, such as (but not limited to) the Internet. Servers networked with a networked enhanced head-to-head hybrid game 160 can also communicate with each of the components of a networked enhanced head-to-head hybrid game and amongst the other servers in communication with the networked enhanced head-to-head hybrid game 160.

Although various networked enhanced head-to-head hybrid games are discussed above, networked enhanced head-to-head hybrid games can be configured in any manner as appropriate to the requirements of a specific application in accordance with embodiments of the invention. Assignment of random elements within enhanced head-to-head hybrid games are discussed further below.

Play Structure

In many embodiments, one or more players compete in an enhanced head-to-head hybrid game system that allows for head-to-head play. Game play can be head-to-head or multi-player as a function of the specific hybrid game in question. Players can play simultaneously or asynchronously depending upon the nature of the specific hybrid game. Head-to-head play can be player vs. machine in a single-player mode or multi-player mode, and can also be player v. machine and/or other player(s) as a function of the specific hybrid game in question. Players may not necessarily know if they are competing against other players or against a machine. Additionally, the system includes the ways and means to allow players to participate in tournament play organized by players or operators.

In some embodiments, head-to-head play can involve players across a number of networked game machines or it can involve players competing on independent machines either serially or simultaneously and their scores being compared manually or automatically at the close of the tournament. Head-to-head play may be time based and/or goal based. Players may compete for a set amount of real or virtual time (baskets scored in X minutes, words played in Y time, etc.) or players may compete until a specific goal is reached (a race track is completed, Z enemies eliminated, all tiles used, etc.)

In numerous embodiments, players can be exposed to their competitor(s)'s profiles during the head-to-head process, such that the "identity" of their competitor(s) is known in the form of a user name, avatar or other defining characteristic(s). In another aspect of this feature, a leader board can be posted to each machine through the GWE and GWE Server, allowing players to determine their standing relative to their competitor(s). Such a leader board may use pseudonyms or avatars to preserve player anonymity.

In various embodiments, head-to-head play can take place across a network of a plurality of game machines, with a centralized server connected to the individual games, tracking GW performance across the game machines, each game machine being capable of operating intelligently in the context of a broad GW competition monitored by a central server. Alternately, head-to-head play can take place in the context of a plurality of game machines operating in more of a terminal mode under central control by a centralized server. The games would support these two modes, and could be switched between them. Additionally, head-to-head play can take place across one or a plurality of game machines that are not networked together, using various media to store individual player's results which are then submitted for manual compilation and establishment of the head-to-head and/or tournament winner(s). In addition, head-to-head play can take place on a single game machine that is networked for the purposes of conveying and receiving information (such as player performance, scores, leaders, etc.) and head-to-head competitions between two or more players may occur on a single machine rather than across a network.

Random Elements in Head-To-Head Play

Referring again to FIG. 1A, in a variant to pure skill-based play described above, in numerous embodiments, the enhanced head-to-head hybrid game system includes a global betting manager (GBM) 126. The GBM is a system that coordinates bets that are made across multiple enhanced head-to-head hybrid game system by multiple players. In some implementations it can also support betting by 3rd parties, using a terminal or the like for 3$^{rd}$ party betting 129, relative to the in-game performance of other players. In various embodiments, the GBM can stand alone, or is capable of being embedded in one of a number of systems, including patron management systems, a game world credit exchange system, or can operate independently on one or a number of servers on-site at a casino, as part of a larger network and/or the internet or "cloud" in general. In some embodiments, the GBM also supports the management of lottery tickets issued as a function of game play, as submitted to the GBM by a side bet manager. In some embodiments, a filter function 140 allows 3$^{rd}$ parties to view certain aspects of the play of the enhanced head-to-head hybrid game using a terminal for 3$^{rd}$ party viewing, such as terminal 142.

In some embodiments, the GBM includes a random event module (REM) which, responding to rules determined by the operator, regulator or other appropriate party, may apply a RNG-driven "X-factor" that adds additional randomness to gameplay. The X-factor may be used as a function of the player's performance in the GW as a leveling function. This element would allow players of different skill levels, using associated enhanced head-to-head hybrid games, such as hybrid games 136 and 138, to compete head-to-head. A player with a higher skill level must overcome the random element in gameplay, reducing the impact of his skill on gameplay. The REM driven X-factor may also be used to introduce randomness in games not normally affected by random chance such as chess. Random events may be included independently of GW performance (in chess, a piece might not respond to a command simulating the "fog of war", forcing a less desirable move by the player, in first person character game this might result in the character stepping on a mine or hidden poison spike, a beast might appear and attack a character while fighting other foes, solely drawing vowels in Scrabble, etc.). While the X-factor may not be determinant, the increased randomness reduces the impact skill has on the outcome. The impact that the REM's elements confer upon the game may be increased or decreased based on the application, regulatory rules and/or maintaining a healthy competitive environment. Handicapping, through use of an X factor or random element, or other player-skill scaling applied to one or more players may also be incorporated to balance competition. The REM may operate solely on a single player's environment, or may apply the X-factor across a plurality of player's involved in a tournament. As such, the REM may exist as a module within a Hybrid Game, a GBM or as part of a system to which one or a plurality of enhanced head-to-head hybrid game system are connected.

Figure 2A:
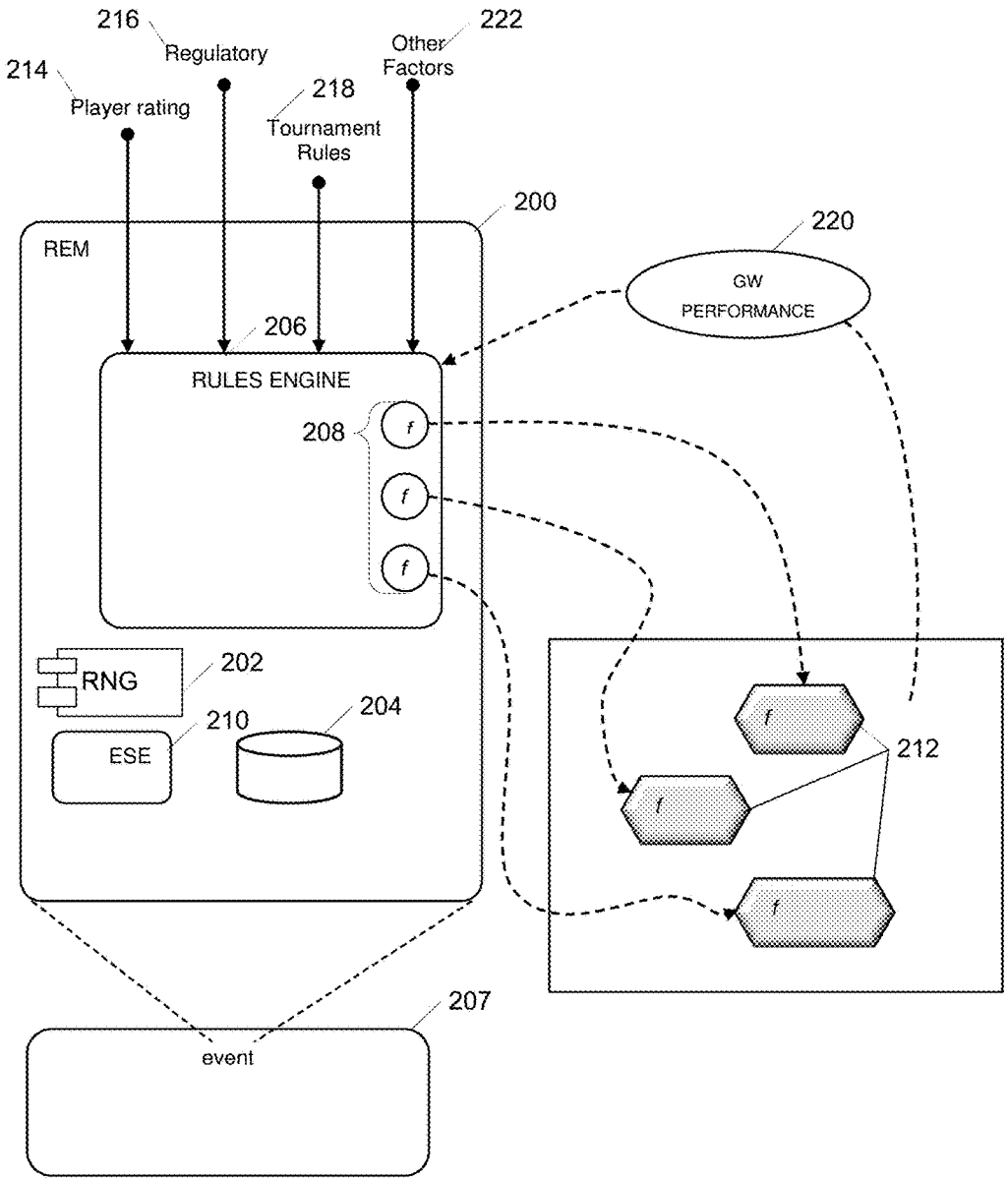
FIGS. 2A and 2B are diagrams of a process using random elements, or X factors, during head-to-head play in accordance with an embodiment of the invention.
Figure 2B:
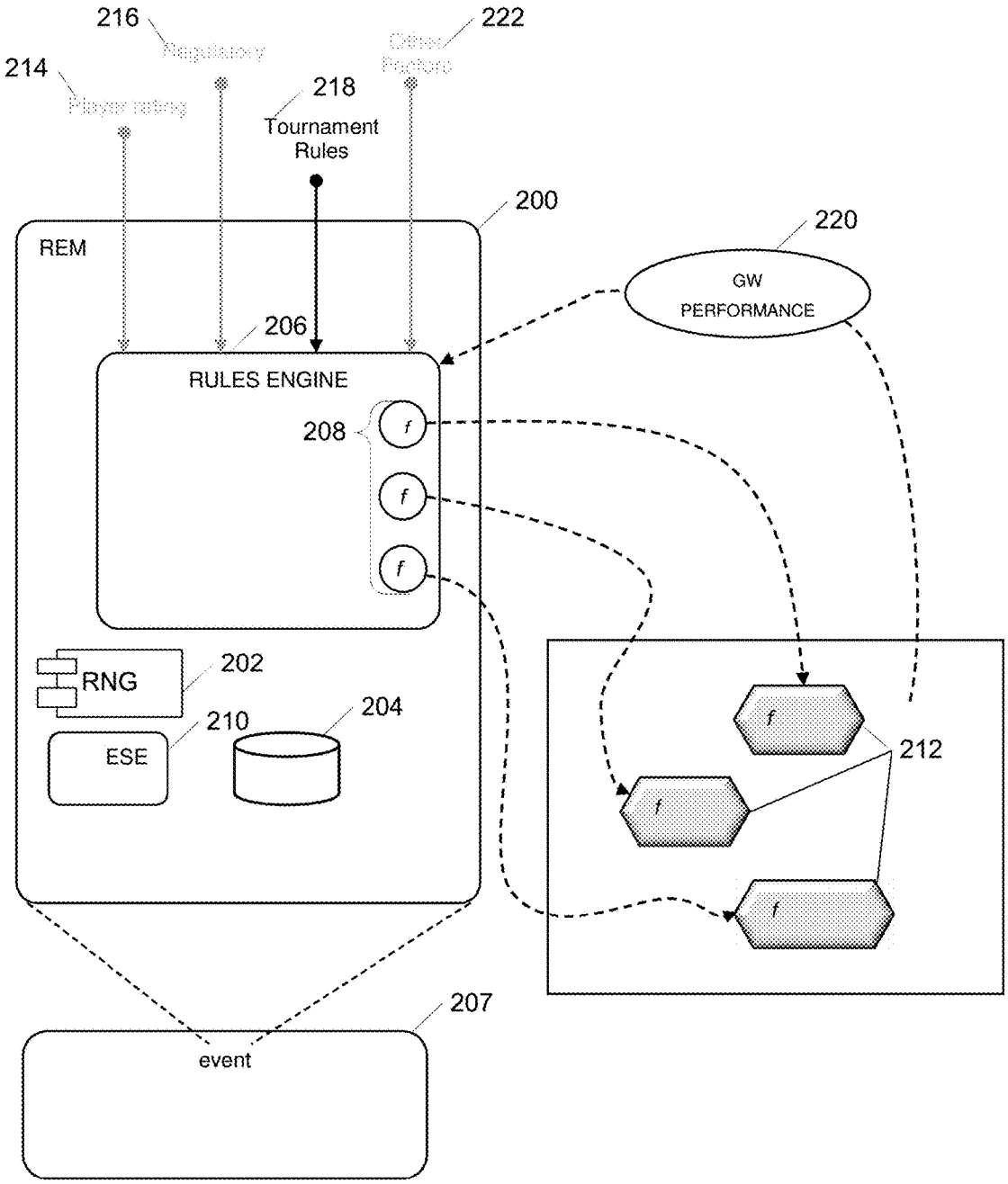

FIGS. 2A and 2B are diagrams of a process using random elements in accordance with an embodiment of the invention. A REM 200 includes a random number generator 202 (RNG), a memory 204 and a rules engine 206. An event 207 in the game world causes the rules engine 206 using formulae 208 ("f") to cause ESE 210 game world impacts as X factor elements 212, such as introducing other events, constructs (such as an attacking beast) and impacting odds of success of player attempts in the game world. Any individual or a multitude of sources may factor into the formulae, such as player ratings 214, a regulatory requirement 216, tournament rules 218 set by an operator, game world performance 220 by one or more players, or by other factors 222.

In FIG. 2B, the REM 200 is shown receiving input from one source, namely tournament rules 218, rather than multiple sources. This aspect demonstrates how the REM would function if the X-factor were based solely on tournament rules. For example, a tournament for a shooting game may use a "nighttime" environment, which adds an additional REM element.

Although various enhanced head-to-head hybrid games constructed to assign random elements to players are discussed above, enhanced head-to-head hybrid games can be constructed to assign random elements as X factor elements in any manner as appropriate to the requirements of a specific application in accordance with embodiments of the invention.

Tournament Play

In many embodiments, the GWE contains systems to allow an operator to define specific requirements for entrance into a tournament including, but not limited to: demonstrated skill level, self-identified skill level, minimum number of games played, total time either virtual or actual played, participation in a player registry, and/or a combination of above factors.

Figure 3:
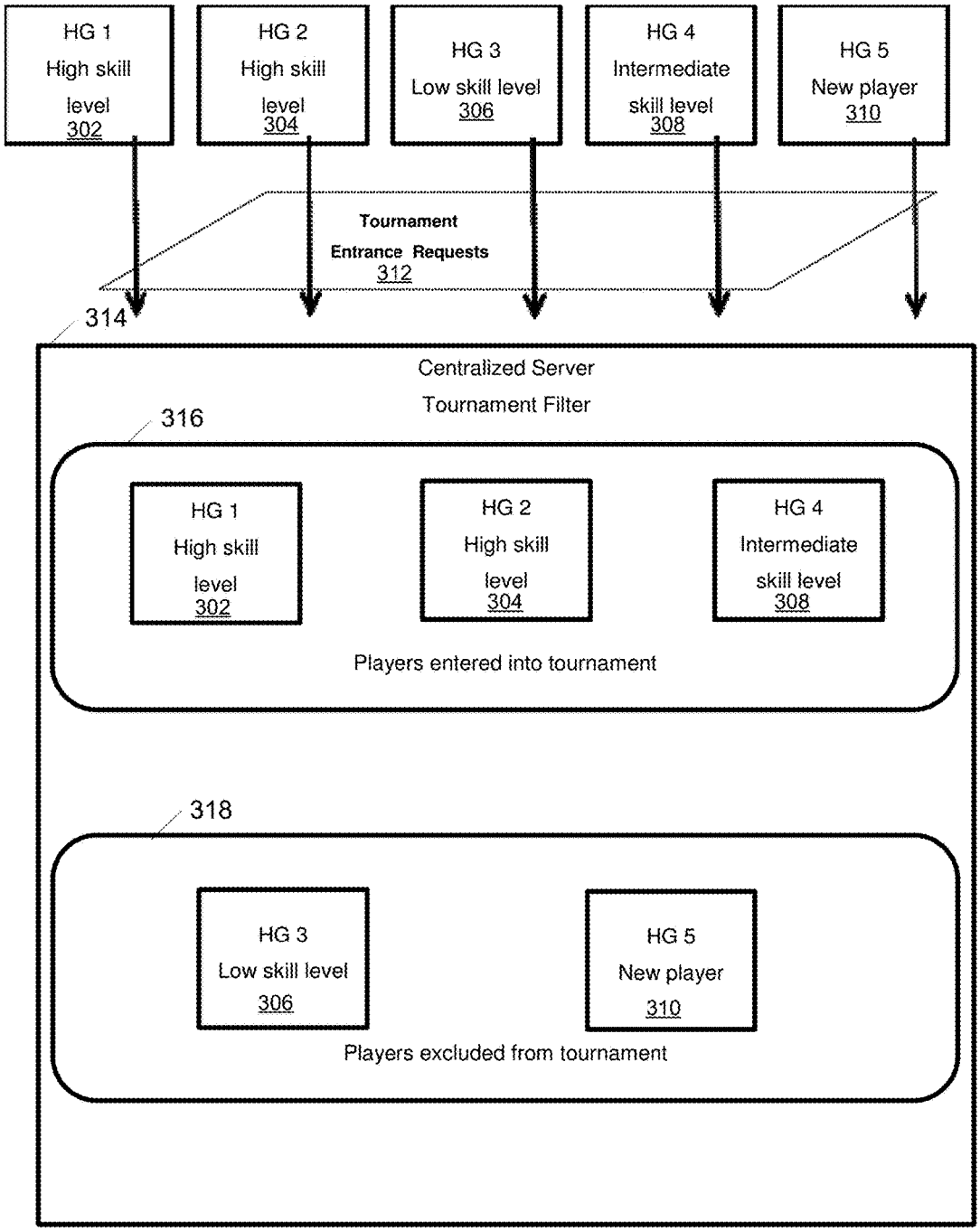
FIG. 3 is a diagram of a process using player performance measurements to control inclusion and exclusion of players in a head-to-head tournament in accordance with an embodiment of the invention.

FIG. 3 is a diagram of a process using player performance measurements to control inclusion in a head-to-head tournament in accordance with an embodiment of the invention. FIG. 3 shows players playing five individual enhanced head-to-head hybrid games 302, 304, 306, 308 and 310, signaling (312) interest in entering tournament play. The requests are filtered through a central server having a tournament filter 314, which may be based in the internet and thus outside a physical casino. The tournament filter determines which players may enter (316) the tournament or may be excluded (318). In the specific case depicted, the players must have a minimum demonstrated skill level to participate in tournament play. The player of enhanced head-to-head hybrid game 306 and enhanced head-to-head hybrid game 310 do not meet this minimum requirement, so they are not permitted to participate in this specific tournament.

In numerous embodiments, tournaments can be formally scheduled events or ad hoc events triggered by a variety of events, including, but not limited to: player reaching a specific ranking or skill level, earning sufficient GWC, sufficient numbers of available players participating, and/or number of games played by a specific player or group of players. Formally scheduled tournaments may be open to all players or to specifically invited players. Such invitations may be based on rankings, marketing events, bonuses from other play and/or a combination of factors. A wide range of variations to the tournament format can be added, including the use of a loser's bracket that can necessitate the payment of an additional entry fee to continue. Tournament play takes place in levels B1 through Bn.

In some embodiments, in addition to tournaments set up on a scheduled or ad-hoc basis by the casino, another aspect would permit tournaments organized directly by players. Players can define the size of the tournament, time and place, rules, entry cost and prizes using guidelines defined by the casino through the system. Players may invite specific players or unnamed players (i.e. an open invitation or "challenge") to compete in tournament play.

In many embodiments, operators may offer prizes for tournament play. These tournaments can include player vs. player, player vs. machine or a combination of both players and machines. In a non-inclusive list, Operators may award prizes that consist of RC, GWC, GW bonus features, rank advancements, qualification for future tournaments, free admission to future tournaments, marketing rewards, and/or a combination of above prizes.

In some embodiments, operators may determine what prizes are awarded or permitted for player-run tournaments in addition to operator-run tournaments. In a non-inclusive list, operators may award prizes that consist of RC, GWC, GW bonus features, rank advancements, qualification for future tournaments, free admission to future tournaments, marketing rewards, and/or a combination of above prizes.

In many embodiments, both player-run tournaments and operator-run tournaments may or may not necessitate payment of an entry fee to the operator, payment of GWC, and may or may not pay out cash or other prizes to the winner(s). An entry fee could consist of RC, GWC or other currency.

In numerous embodiments, in both operator-run and player-run tournaments, the game, on behalf of the operator, may take a tax at various points in the game. This tax could be collected at periodic intervals of real time or virtual time, by completion of a side-bet, by portions of an enabling element (EE), which is a game world element consumed by operation of the entertainment game by a player and that is correlated by the enhanced head-to-head hybrid game to a real world credit by triggering the execution of the gambling game to consume a real word credit when the player operates the entertainment game and consumes the enabling element, consumed/accumulated, upon a specific action in the game, (defeating a foe in the tournament, using a specific weapon or placing a certain letter, etc.), by change in player rankings, based on the GWC accumulation or depreciation rate, and/or a combination of above factors or other factors.

In various embodiments, the tax funds a pool for the tournament winnings. The funds may be distributed according to one or more of the following: GWC score for the tournament, EE remaining for the player, characteristics of the player in the GW context (their health points, status, how much equipment they accumulated, etc.), specific goals reached (defeating X number of foes, exploring certain rooms, finishing races, etc.), efficiency of EE used, real or virtual time required to complete specific goals (placing letters, completing a particular race), overall change in ranking relative to past performances (defeating higher ranked opponents, moving higher in a ladder ranking system, etc.), performance compared to other players, and/or a combination of the above factors or other factors based on what is allowed by gaming regulations in the particular jurisdiction.

Fees for Head-To-Head Play

In numerous embodiments, skill-influenced head-to-head gameplay may or may not necessitate payment of an entry fee, payment of GWC, and may or may not pay out cash or other prizes to the winner(s). An entry fee could consist of RC, GWC or other currency. Entry fees may be variable based on player skill level, geographic location, machine or console type, player club status or a variety of other factors.

In some embodiments, head-to-head play may require no entry fee, instead charging real world credit (RC), GWC or other currency for the EE, an action element (AE) which is a game world element consumed by operation of the entertainment game by a player and that is correlated by the enhanced head-to-head hybrid game to a real world credit by triggering the execution of the gambling game to consume the real word credit when the player operates the entertainment game and consumes without replacement or replenishment the action element, or other means necessary to play the game. The player may elect to purchase more or less EE, AE or other means as compared to their competition (an accurate shooter may purchase less ammunition, while a less accurate shooter purchases a great deal of ammunition). Additionally, the Operator may choose to charge both for entrance and for game elements needed. For instance, the entrance fee may be a flat rate required for participation and then the Operator may charge an additional fee for more EE or bonus features (in Battleship, it costs 10 credits to play, and each normal bomb costs 1 credit, but a "mega-bomb" costs an additional 10 credits). Additionally, actual gameplay may be free, but bonus or premium features require additional RC, GWC or other currency. These bonus features could include purely cosmetic effects (additional car colors, spell animations, etc.) or advantages for actual gameplay (more accurate guns, better armor, additional health points, etc.).

In some embodiments, in head-to-head play, the enhanced head-to-head hybrid game or GBM (of FIG. 1A) on behalf of the operator, may take a "tax" at various points during the game. This tax could be in addition to an entry fee or other play cost. The tax could be collected (in a listing meant to be exemplary rather than comprehensive) at periodic intervals of real time or virtual time, upon a specific action in the game, (defeating a foe in the tournament, using a specific weapon or placing a certain letter, etc.), by collection or consumption of EE, by change in player rankings, based on the GWC, accumulation or depreciation rate of player ranking, and/or a combination of above factors.

In numerous embodiments, a player may put up a stake at the start of gameplay from which the tax is taken via the RWE, GWE, or GBM. The stake may be the entry fee associated with the game. This stake consists of RC, GWC or other currency. As determined by the operator, if a player's stake is insufficient to cover the tax, the player may either be required to exit the game, permitted to continue competing without a chance of award or prize, or asked to contribute additional funds.

Rank Assignments

Performance in the context of the entertainment game in accordance with many embodiments of the invention is a function of both player skill and a certain degree of randomness introduced during entertainment game play. In order to apply the correct X factor or random element, a player's skill level is ranked. As a player's skill level increases or decreases, the player's overall rank, and therefore X factor or random element, can be adjusted to reflect the change in player skill level. Additionally, a player's skill level at a particular entertainment game may not be related to the player's skill level at other entertainment games. For example, success in a racing type entertainment game may not be indicative of the player's skill level in a shooting type entertainment game. However, a player's skill level in one game may be related to a player's skill level in a related game, such as sequels to the same entertainment game.

In many embodiments, a player may be ranked depending on the ratings of the player's opponents, and the results of the player's play against the opponents. In certain embodiments, the relative difference in rating between two players determines an estimate for the expected score between them. The design of the ranking system, including the range and mean rank may be chosen by the operator as appropriate for the enhanced head-to-head hybrid game. Thereby, rankings are calculated based on the strength of a player's opponent and the actual results of the game play between the players. This system, where performance is not measured absolutely, allows handicapping using X factors or random elements inferred from wins, losses, and draws against other players. If a player wins a game, the player is assumed to perform at a higher level than his opponent for that game. Conversely if a player loses, the player is assumed to perform at a lower level than the opponent. If the game is a draw, the two players are assumed to perform at nearly the same skill level.

In several embodiments, these rankings are then used to predict performance so handicapping using X factors or random elements can be applied. When a player's results exceed the player's expected scores, the system takes this as evidence that a player's ranking is too low, and can be adjusted upward. Similarly when a player's actual results fall short of the player's expected scores, that player's ranking can be adjusted downward. The global betting manager may use a simple linear adjustment proportional to the amount by which a player over performed or underperformed the expected score. This type of system can be used in a variety of entertainment games. Additionally, this rating can be applied when a player's performance is measured over time, rather than during play of single gaming session. The adjustment mechanism may also include a "deadband" or weighting functionality such that the player's rating is not immediately adjusted solely as a function of a single or recent performance(s), but rather considers recent results in the context of a broader set of player performance data.

In numerous embodiments, different rankings can be divided into "bands of skill," (similar but not the same as the popular chess ranking system Elo, where a player with an Elorating from 2000-2199 may be considered an expert, while a rating from 600-799 may be considered a beginner). This allows a general X factor or random element to be assigned to different skill bands rather than to individual ranks depending on the entertainment game in question.

In a variety of embodiments, players are placed on a "ladder" and each player is assigned a numerical value that shows how skilled the player is at a certain game. The ladder system proceeds via a system of challenges. Head to head games may occur on a scheduled or ad hoc basis between different rungs on the ladder. In ad hoc play, a first player may challenge a player at a higher level on the ladder. In certain embodiments, refusing a challenge may lead to penalties for the refusing player (such as but not limited to reduction in rank, and/or being barred from tournaments). If the low-ranked player wins the match, then the two players swap places on the ladder or are moved up and down a certain number of "rungs" on the ladder (which may also affect the position of other players between the two rungs initially occupied by the two players). If the low ranked player loses, then that player may be banned from challenging the same person again without challenging someone else first. There may be a limit as to how many rungs above themselves players may challenge. Initial placement on the ladder may be random or deterministic based upon an entry test/challenge.

In a number of embodiments, player ranking may be assigned on level based progression. A player can accumulate experience points (XP) based on play time, tasks undertaken, skills learned and/or a variety of other criterion. To "level" or "level up," a player gains enough XP to reach the next level. When a level is gained, the player's abilities or statistics increase, making the player stronger. In a number of embodiments, a player's ranking is based (at least in part) on the level attained by the player, and a X factor or random element assigned accordingly.

In many embodiments, skill level may be assigned based on performance in specific aspects of the game. In certain embodiments involving a hunting game, factors including but not limited to accuracy, type of animals killed, and kill quantities may be valued separately and then combined to provide the overall ranking. In particular embodiments, skill level is not necessarily based on wins/loses, and handicapping using X factors or random elements may be applied based on specific aspects of the game (a skilled player in each aspect of the above hunting game may be handicapped with using X factors or random elements such as, but not limited to, less accurate guns, fewer numbers of animals, or more difficult kill-shots).

In several embodiments, there can be a short period at the onset of game play during which the global betting manager assesses player's current skill level and evaluates that skill level relative to the player's historical skill level(s) before applying the appropriate X factor or random element. In a number of embodiments, the global betting manager assesses player skill level throughout game play to evaluate the player's skill level. The global betting manager may then apply the appropriate X factor or random element at the conclusion of the game play session.

In various embodiments, a player can use an enhanced head-to-head hybrid game in a mode (such as for a short period of time and/or without payment) whereby the player is "tested" to establish a skill rating. This mode can be finite rather than at the beginning of gameplay. Also, this test mode can be distinct from actual gameplay.

In numerous embodiments, if no professed skill is on record, players may select the skill level they believe to be appropriate. This selection could be incorporated into player/account selection at the start of gameplay rather than as a separate event. As play continues, the player's performance is measured and compared to others of the professed skill level. Where there are discrepancies, the rating assigned and the X factor or random element applied is adjusted. Alternatively, players that estimate their performance inaccurately may be disqualified from play.

In several embodiments, ranking systems can implement skill floors for individual players. A skill floor is the minimum ranking that a player can fall to. For instance, if a player has an established ranking of "expert", subsequent poor performances cannot reduce his ranking to "beginner." However, depending on the hybrid game in question, an "expert" player may have his or her rank decreased to an "intermediate player," depending on the skill floor assigned. A skill floor may be assigned according to any arbitrary criteria, including but not limited to the number of games played, amount of money won, amount of games won, and/or additional factors that can be used establish a player's skill level.

Several embodiments may or may not require participation in a player club. When a player club is unavailable or a player elects not to participate in one, the player is still identified. Rather than linked explicitly to a specific account, the player is anonymously tracked, via the use of a ticket, code, or other means by which a player is given a unique ID that persists but is not tied to a player's person (such as but not limited to not being linked specifically to the player's name).

In numerous embodiments, rankings may be continuous or discrete. Rankings may be specific to the casino, the casino family, and/or geographic location or other divisions. The global betting manager may function to normalize disparate rankings or rankings across multiple systems and locations.

Figure 4A:
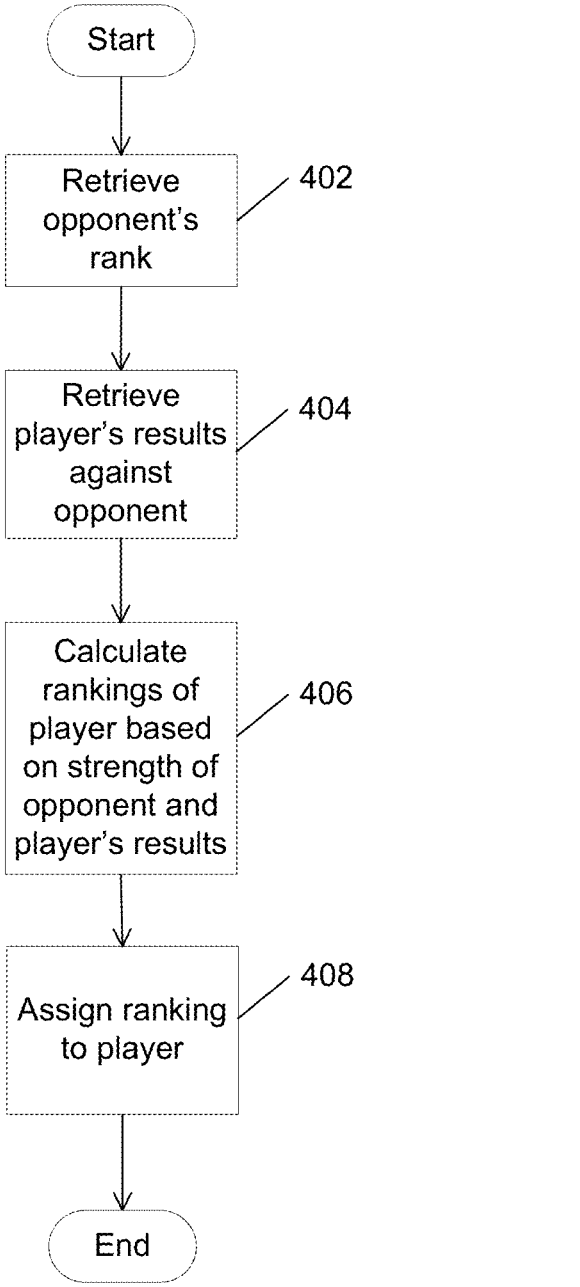
FIG. 4A is a flow diagram of a process of using player performance measurements during head to head play with other player's whose rankings are known in accordance with an embodiment of the invention.

A flow chart of a process of using player performance measurements during head to head play with other player's whose rankings are known in accordance with an embodiment of the invention is illustrated in FIG. 4A. The process includes a global betting manager retrieving (402) an opponent's rank from a GWE. The process also includes retrieving (404) the results of a player's performance against the opponent. These results can be stored in the GWE and retrieved after a game play session has ended or may be retrieved in real time as the players compete. The processes of a global betting manager retrieving an opponent's rank (402) or a player's results against an opponent (404) can be performed in any order. Player rankings are calculated (406) based upon the opponent's rank and the results of the player's performance against the opponent. After player rankings are calculated (406), the rankings can be assigned (408) to the player.

Figure 4B:
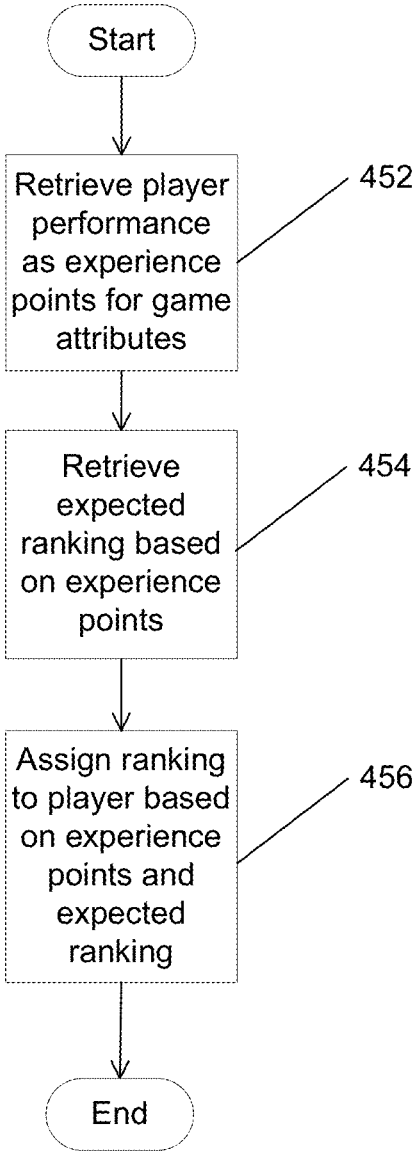
FIG. 4B is a flow diagram of a process to rank a player based on experience points accumulated in accordance with an embodiment of the invention.

A flow chart of a process to rank a player based on experience points accumulated in accordance with an embodiment of the invention is illustrated in FIG. 4B. This process 450 includes a global betting manager retrieving (452) player performance from a GWE as experience points that the player earns while playing an enhanced head-to-head hybrid game with a set of game play attributes, such as but not limited to the difficulty of play or the level that the player is playing. Also, expected ranking based upon experience points earned by a player historically can also be retrieved (452) by the global betting manager from a GWE. These expected rankings and current performance based upon experience points can be analyzed (456) by the global betting manager to assign a ranking to the player.

Although various enhanced head-to-head hybrid games constructed to assign rank to players are discussed above, enhanced head-to-head hybrid games can be constructed to assign rank in any manner as appropriate to the requirements of a specific application in accordance with embodiments of the invention. Evaluation of rank in enhanced head-to-head hybrid games are discussed further below.

Rank Evaluations

An X factor or random element may be assigned to a skilled player in accordance with many embodiments of the invention after a player's rank is established. These assignments may vary based on a variety of factors including, but not limited to, the type of enhanced head-to-head hybrid game, the type of ranking, measureable GW elements, and operator preference.

In several embodiments, utilization of a global betting manager can disadvantage more skilled player(s) in order to provide fair game play irrespective of player skill. These disadvantages can occur through (but are not limited to) introducing a random element or element(s) into the game, changing the player's options, relative scoring, or adjusting overall score at the end of gameplay. In a shooting game, for example, the accuracy with which shots can be aimed at targets can be a function of the aim of the player plus a random component that impacts the trajectory of the player's shot. For a more skilled player, the random component may be increased, decreasing the effect of the player's skill. In a racing game, the cars available to more skilled players may break down more readily. In a shooting game, the more skilled player may not be able to use certain guns or other weaponry. In a basketball shooting game, the player's baskets may be worth 1 point instead of two points.

In a number of embodiments, game play itself is not affected through the utilization of a global betting manager, but the payouts available may vary. Asymmetrical bets could be structured in accord with the skill level of each player. In certain embodiments, if a low skill player is matched against a high skill player, the high skill player may enter into a bet with the low skill player that provides the low skill player with better odds. Therefore, the bet is structured in such a way that the potential winnings vary accordingly. For example, a high skilled player and a low skilled player may both be required to bet 10 credits. If the high skilled player wins, the high skilled player would receive 14 credits. If the low skilled player wins, the low skilled player receives 16 credits. The remaining balance may be taken by the operator as a rake. In another example, players may have to place asymmetrical stakes for gameplay. For example, in a chess game the high skill player may wager 100 credits, while the low skill player may wager 10 credits. The low skill could potentially win 100 credits (minus what the operator may claim as a rake), while the high skill player could win 10 (minus what the operator may claim as a rake).

Figure 5A:
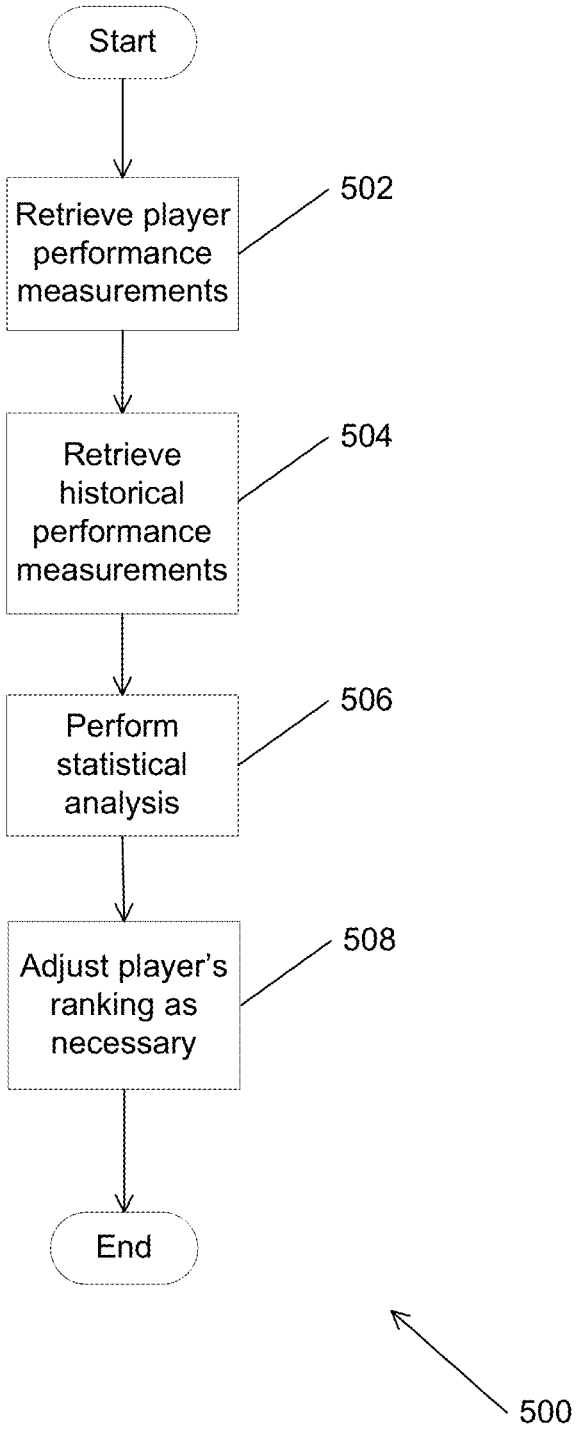
FIG. 5A is a process flow diagram of a process for determining if a player's current performance at an enhanced head-to-head hybrid game exceeds historical performance in accordance with an embodiment of the invention.

A process flow diagram of a process for determining if a player's current performance at an enhanced head-to-head hybrid game exceeds historical performance in accordance with an embodiment of the invention is illustrated in FIG. 5A. The process 500 includes a global betting manager retrieving current player performance measurements (502) and historical performance measurements (504) from an enhanced head-to-head hybrid game. Historical performance measurements can be the particular player's historical performance measurements or historical performance measurements from a group of players. The order in which current player performance measurements and historical performance measurements are retrieved is non-limiting and can be retrieved in any order. The global betting manager then performs (506) statistical analysis upon the current player performance measurements and historical performance measurements. If there is sufficient deviation from expected performance measurements, then the player's rankings and corresponding using X factors or random elements can be adjusted (508) accordingly. In various embodiments, the player's ranking, and subsequent handicap may be re-ranked upward to a higher rank. However, if the currently player's performance measurement information indicates a poorer quality of fair play during the current play session, the player's rank, and subsequent using X factors or random elements, may be adjusted to a lower value.

In many embodiments, an outlier test is used to determine if the player's current performance information indicates that the player has significantly deviated from expected performance. In certain embodiments, an outlier test such as (but not limited to) the Grubb's outlier test can be used. The Grubb's outlier test can be used to detect outliers in a data set assumed to come from a normally distributed population. To perform the Grubb test, a value T is calculated:

$$T=\mathrm{Abs}(Xi-X\mathrm{mean})/s$$

where:

Abs( )=absolute value function;

Xi=observed player performance measurements for a current play session;

Xmean=mean of historical player performance measurements for previous play sessions; and s=standard deviation of Xmean.

Once T is calculated, a lookup table is used to determine the probability that a rejection of Xi as belonging to the population of Xmean is improper. For example, the lookup table illustrated in FIG. 5B can be utilized. In FIG. 5B, the headings represent the probability, in percentages, that a rejection is improper, and N is the number of sampled historical data points for player performance that were used to calculate Xmean.

In other embodiments, any technique for determining whether player performance is inconsistent with past performance can be utilized as appropriate to the requirements of a specific enhanced head-to-head hybrid game.

The table is used by looking up the value of Tin the table for the number N samples. Then, the probability is determined by looking up the column to the probability value featured in the header. For example, if N=20 sampled player performance measurements and T is calculated to be 2.71, then the rejection of Xi as not belonging to the population of the sampled player performance measurements has a 2.5% chance of being improper. Put another way, there is a 97.5% chance the particular instance of player performance is proper.

In several embodiments, outlier tests such as (but not limited to) Dixon's Q-test are used. In a Dixon Q-test, a ratio of distance between a tested value and its next closest value in a set of sampled values as compared to the range of all values in the sample is used to determine if the tested value comes from the same population as the set of sampled values. In certain embodiments, a process for determining a Q-test is as follows.

The sampled values of historical player performance measurements are arranged in ascending order:

$$x_1<x_2<\ldots<x_N$$

A ratio, $Q_{exp}$, is calculated as the difference between the value of the currently player performance measurement, $X_N$, being tested from its nearest neighbor value, $X_{N-1}$, divided by the range of the values of player performances:

$$Q_{exp}=\frac{X_2-X_1}{X_N-X_1}\quad Q_{exp}=\frac{X_N-X_{N-1}}{X_N-X_1}$$

The obtained $Q_{exp}$ value is compared to a critical Q-value ($Q_{crit}$) found in the table containing the critical Q values produced below. If $Q_{exp}>Q_{crit}$ for a particular confidence interval, then the tested player performance value can be characterized as an outlier, that is, that the current player performance measurement may significantly deviate from expected player performance measurements in a statistically meaningful way.

A table containing the critical Q values for confidence level (CL) 90%, 95% and 99% and N=3-10 is given below:

Table of critical values of Q

| N | $Q_{crit}$ (CL: 90%) | $Q_{crit}$ (CL: 95%) | $Q_{crit}$ (CL: 99%) |
|---|---|---|---|
| 3 | 0.941 | 0.970 | 0.994 |
| 4 | 0.765 | 0.829 | 0.926 |
| 5 | 0.642 | 0.710 | 0.821 |
| 6 | 0.560 | 0.625 | 0.740 |
| 7 | 0.507 | 0.568 | 0.680 |
| 8 | 0.468 | 0.526 | 0.634 |
| 9 | 0.437 | 0.493 | 0.598 |
| 10 | 0.412 | 0.466 | 0.568 |

In certain embodiments, the expected performance can be the player's own historical performance while playing a particular hybrid game. In particular embodiments, the expected performance can be the performance of other players having the same or similar ranking as the player in question for a particular hybrid game.

Although various embodiments of enhanced head-to-head hybrid games constructed to evaluate the rank of players are discussed above, enhanced head-to-head hybrid games can be constructed to evaluate rank in any manner as appropriate to the requirements of a specific application in accordance with embodiments of the invention.

Figure 6:
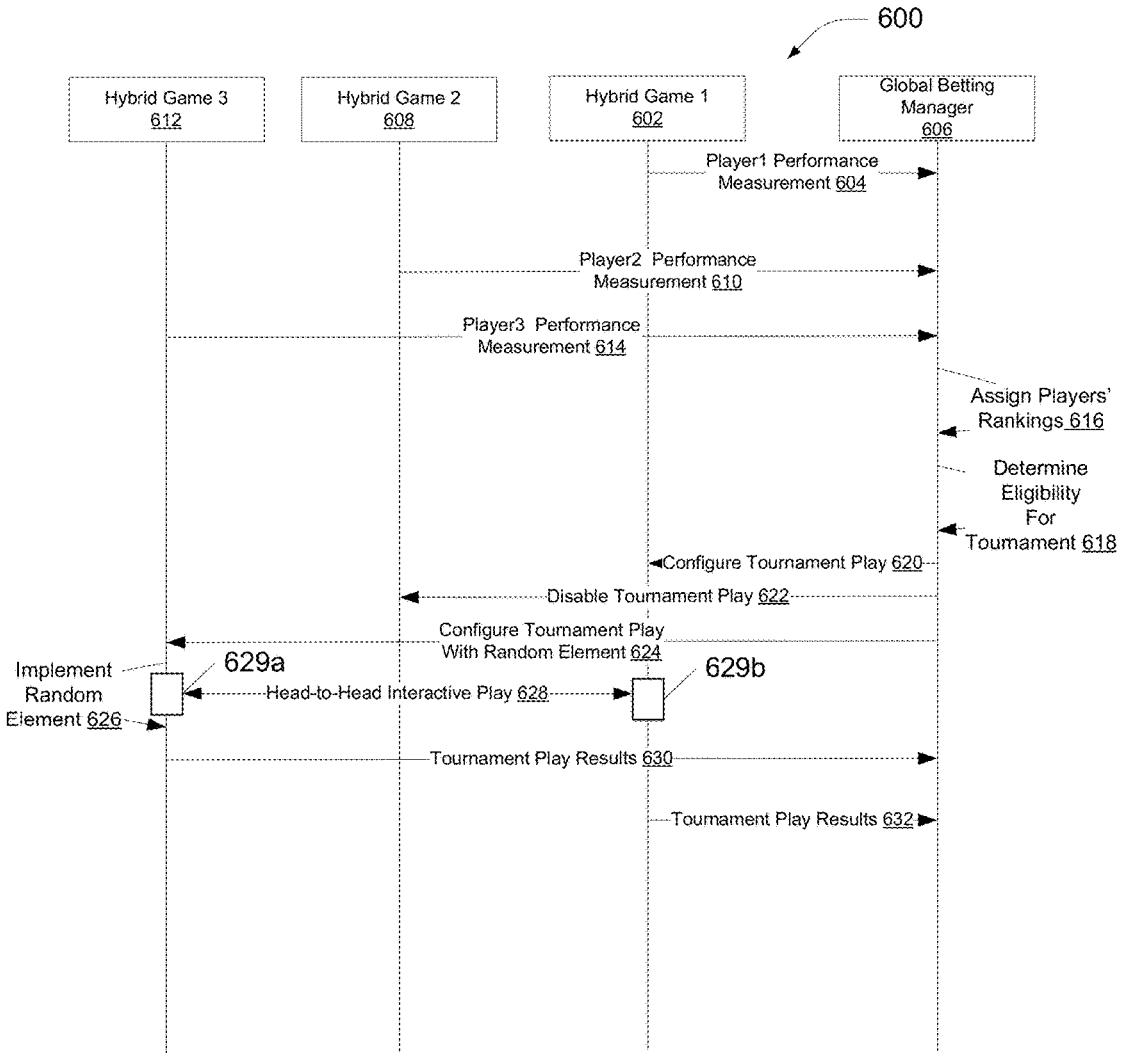
FIG. 6 is a sequence diagram illustrating the operation of enhanced head-to-head hybrid games that implement random elements based upon player ranking in accordance with an embodiment of the invention.

FIG. 6 is a sequence diagram illustrating the operation of enhanced head-to-head hybrid games that implement random elements based upon player ranking in accordance with an embodiment of the invention. As illustrated in the sequence 600, a first enhanced head-to-head hybrid game 602 transmits performance measurement data 604 for a first player playing the enhanced head-to-head hybrid game 602 to a global betting manager 606. The global betting manager receives and stores the performance measurement data. A second enhanced head-to-head hybrid game 606 also sends performance measurement data 610 for a second player to the global betting manager 606. The global betting manager 606 receives and stores the performance information 610. A third enhanced head-to-head hybrid game 612 sends performance information 614 for a third player to the global betting manager 606. The global betting manager receives and stores the performance measurement data 614. The global betting manager determines (616) rankings to the players as described herein using the performance measurement data collected for the players.

In addition, eligibility for inclusion or exclusion in a tournament is determined (618) as described herein for each of the players requesting entry into a tournament. In this example, the first player is determined to be eligible for playing in a tournament, however without any disadvantages. Accordingly, enhanced head-to-head hybrid game 602 is instructed (620) to includes the first player in the tournament. In a like manner, the second player is evaluated for eligibility as described herein, however, for the purposes of this example, the second player is determined to be ineligible. Accordingly, enhanced head-to-head hybrid game 608 is instructed (622) to exclude the second player from the tournament. The third player is also evaluated and determined, for the purposes of this example, as being eligible for inclusion in the tournament. Accordingly, enhanced head-to-head hybrid game 612 is instructed (624) to include the third player in the tournament, however with an X factor or random element to be used to disadvantage the third player.

During execution of head-to-head play during a tournament (629*a* and 629*b*) the third and first player's interact (628) with each other to play a head-to-head entertainment game implemented by the enhanced head-to-head hybrid games 602 and 612. During the head-to-head play and interaction 628, enhanced head-to-head hybrid game 612 implements (626) one or more X factors or random elements as described herein in order to disadvantage the third player.

In some embodiments, the enhanced head-to-head hybrid games 602 and 612 send tournament player results 630 and 632 to the global betting manager 606 for further processing, such as re-ranking the players as described herein.

As described above, only three players were processed. However, it should be understood that any number of players could be processed without deviating from the spirit of various embodiments of the invention. In addition, it should be understood that the particular enhanced head-to-head hybrid game that a player uses to qualify for and to play in a tournament need not be the identical enhanced head-to-head hybrid game. In addition, the timing for determining eligibility need not be in any exact sequence.

In numerous embodiments, the enhanced head-to-head hybrid games do not interact directly with each other during head-to-head play, but instead are part of a gaming system employing a game server that serves as a game engine for a multi-player system. In addition, in various embodiments, the global betting manager interacts with a game server to collect player performance measurement data and/or implement a random element as an X factor to disadvantage a selected player.

Side-Bets in Head-To-Head Play

In some embodiments, when appropriate in the context of head-to-head play, a player can invoke a side bet and challenge one or more other players to accept the side bet this may be done through a global betting manager acting as a side betting module (SBM). One or multiple potential side bet propositions are presented to the initiating player. The initiating player characterizes the bet to be offered to other players (either through selection of a discrete option, or through a more free-form construction process) and selects the players to whom the bet is to be offered. If one or more players (as applicable to the bet type and the number of players participating head-to-head) accept the bet, then the appropriate amount of currency being bet is deducted from each player. Game play commences (or continues if the side bet was made in the midst of game play), and upon completion of the criteria to bring the bet to closure, the appropriate currency payments are made to each player and/or the casino. The use of side bets can be turned on or off, depending on Operator decision, playability purposes and/or player preference.

In various embodiments, placement of bets is supported by third parties that are not directly participating in the play of an enhanced head-to-head hybrid game. The GBM can be configured by the casino to provide betting opportunities for non-players to bet, for example, on the action of play in a particular enhanced head-to-head hybrid game session, to bet on the outcome of a head-to-head game being played by two or more players, or to bet on the results of tournament play. Game status may be broadcast to allow remote viewers and bettors to observe the game. The broadcast could contain a mechanism such as a time delay, shielding of piece locations (shrouding a game board in fog, etc.), shielding confidential material (obscuring the cards in a player's hand, etc.) or other methods to prevent observers from gaining information that they could use to affect the game outcome.

In numerous embodiments, players may assign specific values of RC, GWC or other currency to various game elements. Each player commits a specific stake to one or more game elements in advance or during play as appropriate to the specific hybrid game (in chess the player might value the Queen at 30 credits, the King's Bishop at 5 credits, etc.). The stake attached to that piece may be won by the opponent(s) during gameplay if the opposing player captures, converts, destroys or otherwise defeats the specific piece (from above, capturing the King's Bishop awards 5 credits). This can be applied in non-skill based games as well (e.g. in Battleship where each player has 500 credits, the player may assign the destroyer 200 credits, the submarine 50 credits and the patrol boat 250 credits, while the less skilled player may assign 100 credits to each of the five ships) The total amount of funds assigned may vary based on the skill level of each player. For instance, a more skilled player must stake a total of 500 credits to the board while the less skilled opponent stakes 50 credits (e.g. in Stratego, the skilled player may assign the General 200 credits, the Major 50 credits and a single Sergeant 250 credits, while the less skilled player may assign 10 credits to each of the five miners.) Such allocations may or may not be known to the opposing player.

Referring again to FIG. 1A, in some embodiments, an SBM 129 may optionally be resident within an enhanced head-to-head hybrid game. In such an embodiment, the SBM communicates with the ESE to receive information about the state of game variables (necessary to parameterize and close out bets), and also to receive bet trigger codes that can be interpreted directly, or referenced against a side bet database that contains a list of all prospective side bet types supported by the enhanced head-to-head hybrid game being played, along with acceptable ranges for such bets and the types of currency or player club points that can be bet. The SBM communicates back to the ESE reductions or additions to EE or other game parameters (e.g. if the player won a potion in an adventure game) that ultimately need to be reflected in the entertainment game. The SBM also communicates with the RWE to augment or decrement the amount of RC if the side bet involves RC.

Figure 7:
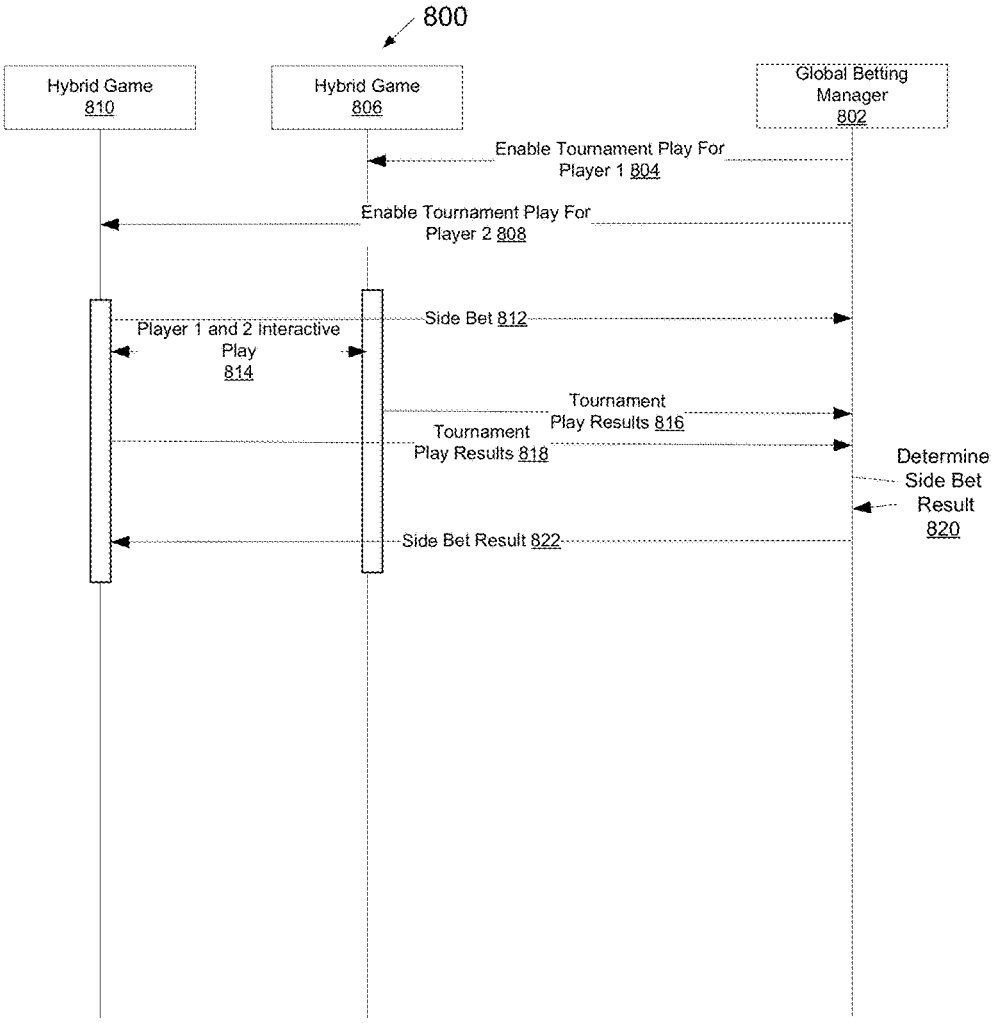
FIG. 7 is a sequence diagram illustrating the operation of enhanced head-to-head hybrid games and a global betting manager that implement side betting in accordance with an embodiment of the invention.
Figure 9:
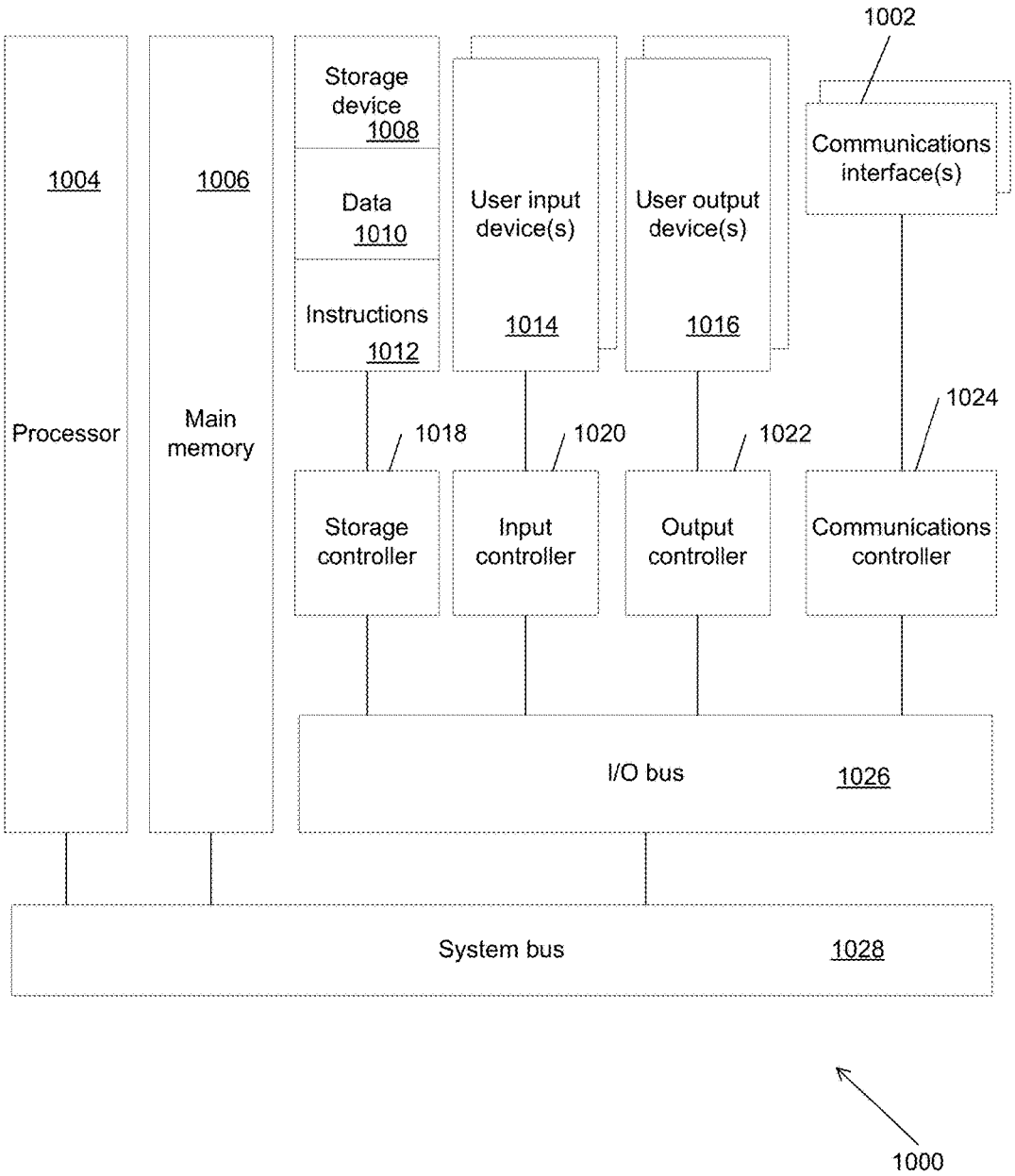
FIG. 9 illustrates a hardware architecture diagram of a processing apparatus for a gaming system in accordance with an embodiment of the invention.

FIG. 7 is a sequence diagram illustrating the operation of enhanced head-to-head hybrid games and a global betting manager that implement side betting in accordance with an embodiment of the invention. In the sequence 800 a global betting manager 802 acting as a side betting module instructs (804) a first enhanced head-to-head hybrid game 806 to enable head-to-head tournament play for a first player. The global betting manager 802 also instructs (808) a second enhanced head-to-head hybrid game 810 to enable head-to-head tournament play for a second player. During the head-to-head play of the tournament, the first player sets up one or more side bets 812 using the global betting manager. Although not shown, it is to be understood that the second player could also set up one or more side bets. During interactive play (814) between the first and second players, the enhanced head-to-head hybrid games transmit tournament play results 816 and 818 to the global betting manager. The global betting manager receives the tournament play results and determines the outcome of a side bet for either of the players as described herein. In this example, as only the first player has made a side bet, the side bet results 822 are transmitted to the enhanced head-to-head hybrid game 810. Of course, it is to be understood that if the second player were to have made a side bet, then side bet results would have also been transmitted to enhanced head-to-head hybrid game 806.

As described above, only two players were described as part of a side bet process. However, it should be understood that side bets for any number of players could be processed without deviating from the spirit of various embodiments of the invention.

In numerous embodiments, the enhanced head-to-head hybrid games do not interact directly with each other during head-to-head play, but instead are part of a gaming system employing a game server that serves as a game engine for a multi-player system. In addition, in various embodiments, the global betting manager interacts with a game server to collect and process side bets for players of the enhanced head-to-head hybrid games.

FIG. 8 is a diagram of a side bet manager database 900 in accordance with an embodiment of the invention. FIG. 8 illustrates the SBM bet database logging information about a specific chess game. The values assigned by a player 1 to the various pieces is monitored and tracked through the SBM and communicated to players and third parties as illustrated in FIG. 7. Processing apparatuses capable of implementing enhanced head-to-head hybrid games, a global betting manager server or a side betting module are discussed further below.

Processing Apparatus

Any of a variety of processing apparatuses can host various components of a gaming system, such as an enhanced head-to-head hybrid game, a global betting manager or side betting module, in accordance with embodiments of the invention. In several embodiments, these processing apparatuses can include, but are not limited to, a gaming machine, a general purpose computer, a computing device and/or a controller. A processing apparatus that is constructed to implement an enhanced head-to-head hybrid game, a global betting manager or a side betting module, in accordance with various embodiments of the invention is illustrated in FIG. 10. In the processing apparatus 1000, a processor 1004 is coupled to a memory 1006 by a bus 1028. The processor 1004 is also coupled to non-transitory processor-readable storage media, such as a storage device 1008 that stores processor-executable instructions 1012 and data 1010 through the system bus 1028 to an I/O bus 1026 through a storage controller 1018. The processor 1004 is also coupled to one or more interfaces that may be used to connect the processor to other processing apparatuses as well as networks as described herein. The processor 1004 is also coupled via the bus to user input devices 1014, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 1004 is connected to these user input devices 1014 through the system bus 1028, to the I/O bus 1026 and through the input controller 1020. The processor 1004 is also coupled via the bus to user output devices 1016 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1028 to the I/O bus 1026 and through the output controller 1022. The processor 1004 can also be connected to a communications interface 1002 from the system bus 1028 to the I/O bus 1026 through a communications controller 1024.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, a GWE, ESE, a global betting manager or a side betting module as described herein can be implemented on multiple processing apparatuses, whether dedicated, shared or distributed in any combination thereof, or may be implemented on a single processing apparatus. In addition, while certain aspects and features of element management processes described herein have been attributed to an RWE, a GWE, ESE, a global betting manager or a side betting module these aspects and features may be implemented in a hybrid form where any of the features or aspects may be performed by any of a RWE, a GWE, ESE, a global betting manager or a side betting module within an enhanced head-to-head hybrid gaming system without deviating from the spirit of the invention.

While the above description includes many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A network distributed hybrid gaming system, comprising:

a real world server connected to a game world server by a network, wherein the real world server is constructed to:

provide a real world credit meter;

receive from the game world server via the network, a trigger of a wager of an amount of real world credits;

provide a randomly generated payout of real world credits for the wager of the amount of real world credits wherein the result is determined using a random number generator; and adjust the real world credit meter based on an outcome from a side bet selection;

a controller connected to the game world server by the network, wherein the controller is constructed to:

provide an entertainment game providing outcomes based upon a player's skillful execution of the entertainment game;

provide a tournament for the entertainment game using head-to-head competition;

generate a perceivable display of the entertainment game;

distribute to the game world server via the network, actions taken by the player during the player's skillful execution of the entertainment game;

distribute to the game world server via the network, game state information; and generate a perceivable display of prospective side bets for the tournament; and distribute to a global betting manager via game world server, the side bet selection; and the game world server connected by the network to the real world server and connected to the controller, wherein the game world server is constructed to:

receive from the controller via the network, the actions taken by the player;

convey to the real world server via the network, the trigger of the wager of the amount of real world credit based on the actions taken by the player; and the global betting manager connected to the game world server and constructed to:

receive, from the controller via the game world server, the game state information;

determine based on the game state information, the prospective side bets available during the tournament;

distribute the prospective side bets to the controller via the game world server;

receive the side bet selection;

receive tournament results;

determine the outcome of the side bet selection; and distribute the outcome of the side bet to the controller and the real world server via the game world server.

2. The network distributed hybrid gaming system of claim 1, wherein the global betting manager is further constructed to:

receive player performance measurements for the player from the game world server;

determine eligibility of the player for play in a tournament;

assign a handicap for the tournament to the player; and distribute information concerning tournament eligibility and the assigned handicap to the game world server that configures the game world server to implement the assigned handicap and tournament eligibility within the network distributed hybrid gaming system.

3. The network distributed hybrid gaming system of claim 2, wherein the global betting manager is further constructed to determine that the player's performance measurements are a significant deviation from expected player performance measurements.

4. The network distributed hybrid gaming system of claim 3, wherein the determining that the player's performance measurements are a significant deviation from expected player performance measurements utilizes an outlier test.

5. The network distributed hybrid gaming system of claim 4, wherein the outlier test is the Grubb's outlier test.

6. The network distributed hybrid gaming system of claim 4, wherein the outlier test is the Dixon Q-test.

7. The network distributed hybrid gaming system of claim 3, wherein the global betting manager is further constructed to adjust the player's handicap upon determining that the player's performance measurements are a significant deviation from expected player performance measurements.

8. The network distributed hybrid gaming system of claim 3, wherein the expected player performance is based upon historical player performance measurements.

9. The network distributed hybrid gaming system of claim 1, wherein the global betting manager is further constructed to distribute the prospective side bets to a non-player.

10. The network distributed hybrid gaming system of claim 1, wherein the game world server and the controller are constructed using a same processing apparatus.

11. The network distributed hybrid gaming system of claim 1, wherein the game world server and the controller are constructed using different processing apparatuses, and wherein the game world server and the controller are connected by respective communication interfaces of the processing apparatuses over a network.

12. The network distributed gaming system of claim 1, wherein the real world credit is a currency fungible instrument.

* * * * *